US005582054A

United States Patent [19]

Yoshino et al.

[11] Patent Number: 5,582,054

[45] Date of Patent: Dec. 10, 1996

[54] METHOD OF PRODUCING BULGE-SHAPED PIPE

[75] Inventors: Makoto Yoshino; Toshiya Etou; Masujirou Takawaki, all of Okazaki; Masaru Ito, Nishio, all of Japan

[73] Assignee: Nippondenso Co., Ltd., Kariya, Japan

[21] Appl. No.: 348,988

[22] Filed: Nov. 28, 1994

[30] Foreign Application Priority Data

Nov. 26, 1993 [JP] Japan ..... 5-295852

[51] Int. Cl.[6] ..... B21D 41/00

[52] U.S. Cl. ..... 72/306; 72/316; 72/370

[58] Field of Search ..... 72/306, 316, 318, 72/356, 370, 367

[56] References Cited

U.S. PATENT DOCUMENTS

| | | | |
|---|---|---|---|
| 3,225,581 | 12/1965 | Hinderer | 72/316 |
| 4,732,030 | 3/1988 | Tanaka | 72/356 |

FOREIGN PATENT DOCUMENTS

| | | | |
|---|---|---|---|
| 626775 | 3/1936 | Germany | 72/370 |
| 106635 | 8/1980 | Japan | 72/316 |
| 499916 | 1/1976 | U.S.S.R. | 72/367 |
| 764820 | 9/1980 | U.S.S.R. | 72/367 |
| 363574 | 12/1931 | United Kingdom | 72/370 |

OTHER PUBLICATIONS

Nikkan Kogyo Newspaper Company: "Pipe Processing Method", Nov. 30, 1988, pp. 98, 99.

*Primary Examiner*—Daniel C. Crane

*Attorney, Agent, or Firm*—Cushman, Darby & Cushman IP Group of Pillsbury Madison & Sutro LLP

[57] ABSTRACT

A method that produces an inexpensive and high-quality male side pipe by forming a seal groove for holding an O-ring only by means of press machining is disclosed. A male side pipe is pressed to form an expanded part at an intermediate part thereof. This expanded part is pressed to form a bulge part. Furthermore, the portion of the male side pipe from a tip end to an intermediate part of the bulge part is contracted to form a seal groove side face and a seal groove bottom face at the side of the bulge part. In addition, the portion, of the male side pipe from the tip end to the point S is pressed for thinning to facilitate the machining on male side pipe. Then, the thinned portion is widened to form a seal groove side face at the side of the tip end. By forming the seal groove side face roughly perpendicular to the axial direction of the male side pipe during these processes, the askew assembly or slanting of the O-ring can be prevented.

12 Claims, 21 Drawing Sheets

(I-I SECTION) PRIOR ART

METHOD OF PRODUCING BULGE-SHAPED PIPE

CROSS REFERENCE TO RELATED APPLICATIONS

This application is based upon and claims priority from Japanese Patent Application No. 5-295852 filed Nov. 26, 1993, the contents of which are hereby incorporated herein by reference.

BACKGROUND OF THE INVENTION

1. Field of the Invention

The present invention generally relates to a method of producing a pipe adapted to be attached to another pipe or hose. More particularly, the present invention relates to a method of producing a pipe that can suitably be applied to pipes, etc., having an O-ring for sealing.

2. Description of Related Art

A spinning method has conventionally been used for forming pipes adapted to have other pipes or hoses connected thereto. Such pipes are conventionally used to carry a high-pressure or low-pressure fluid. The attached pipes or pipe and hose include a cylindrical seal shape having a seal groove for holding an annularly recessed O-ring in the periphery thereof.

The spinning method is illustrated in FIGS. 20A and 20B. Pipe 9 is set on a spinning machine, and spinning roller 60 contacts a part of pipe 9 by pressing thereagainst where seal groove 16 is formed for holding an O-ring therein. Then, by rotating spinning roller 60 around the periphery of pipe 9 in the direction indicated by arrow a in FIG. 20B, while roller 60 spins or rotates in the direction indicated by arrow b in FIG. 20B, a part of outside diameter 61 of pipe 9 gradually has a recess formed therein, which is seal groove 16 for holding an O-ring.

However, the spinning method described above, which is the conventional method of forming a pipe with a cylindrical seal recess, has been found to certain problems. Namely, the material surface of the bottom face of seal groove 16 for holding an O-ring is pulled, and consequently, the material is drawn to the bottom face of the seal groove, as indicated by point R in FIG. 20B. As a result, in some cases, it is difficult to achieve the required roughness of the seal face, which in turn causes leaks due to defective sealing.

In addition, as the outside diameter of a pipe is pressed and then the seal groove for holding an O-ring is spun, time is required to remove the pipe from the press and set it onto the roller. As a result, it becomes more difficult to achieve the required concentricity between the outside diameter and seal groove bottom face of the pipe.

SUMMARY OF THE INVENTION

In view of the above difficulties associated with the related art, the present invention has as an object the provision of a method of forming a pipe into a cylindrical seal shape only by means of pressing. It is a further object of the present invention to produce a pipe having the required concentricity between the outer diameter thereof and the seal groove at a high productivity rate and at low cost.

To achieve the above objects, the present invention is directed towards a method for producing a pipe including the steps of expanding a pipe by pressing a metal pipe cut to a specified length in order to expand an intermediate part of the pipe outwards, pressing the expanded portion of the pipe to form a bulge shape, externally pressing the pipe to contract towards the inside thereof at a portion extending from a tip end to an intermediate part of the bulge-shaped portion, and the step of widening towards the outside of the pipe for the specified length at the portion extending from the tip end to an intermediate part of the contracted portion to form a groove in the intermediate part of the pipe.

By using such a method, a groove can be formed in the intermediate part of a pipe only by pressing. That is, rolling is not required as in the prior art. Therefore, the present invention has remarkable effects, which are that the machining process can easily be automated and the time required for machining can be reduced.

In addition, as there is no need to set a pipe to a roller for spinning, the man-hours necessary to produce such a pipe are also reduced, as no work need to be performed to remove or set the pipe i/on a roller. Thus, as there is no need to remove the pipe from the press during machining, a good concentricity can be maintained between the outside diameter and the groove of the pipe. Utilizing the present invention, when the groove is provided with an O-ring which has a sealing function, the O-ring is uniformly compressed and a good seal is formed and maintained, whereby a high-quality pipe can be provided. Also, due to the elimination of the need for spinning, a roller is not a requisite part of the equipment, thus further reducing production costs. As a result, high productivity is achieved, and it is possible to manufacture inexpensive products. Further, the present method removes the problem of material drawn to the groove bottom face, and thus there is no problem in ensuring the necessary roughness.

As is apparent from the above description, the present invention provides a method of producing metal pipes, with the method having unprecedented, remarkable effects.

BRIEF DESCRIPTION OF THE DRAWINGS

These and other objects of the present invention will become apparent to a person of ordinary skill in the art, as will the functions of the related elements of the structure, from a study of the following detailed description in conjunction with the appended claims and drawings. In the drawings:

DETAILED DESCRIPTION OF THE PRESENTLY PREFERRED EXEMPLARY EMBODIMENTS

The present invention will be described in connection with an example of the present invention used with a refrigerant pipe of an air-conditioning system for vehicles.

Figure 5:
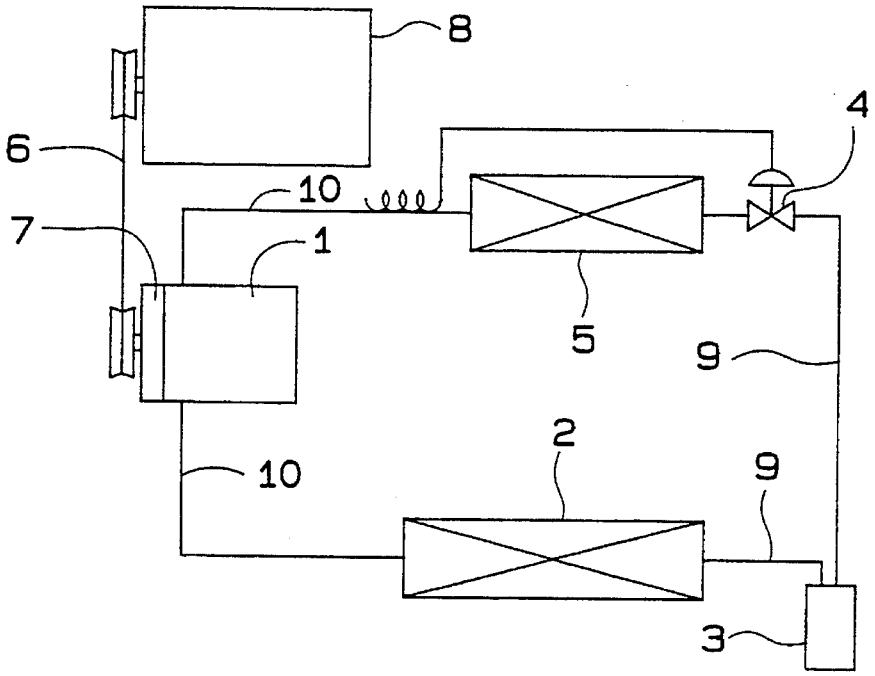
FIG. 5 is a schematic drawing illustrating a refrigerating cycle in which the present invention may be utilized.

FIG. 5 is a schematic drawing illustrating the refrigerating cycle of an air-conditioning system for a motor vehicle. The refrigerating cycle is includes compressor 1, condenser 2, receiver 3, expansion valve 4 and evaporator 5 and is driven by driving engine 8 via belt 6 and clutch 7. Compressor 1, condenser 2, receiver 3, expansion valve 4 and evaporator 5 are connected to each other by pipes 9 or hoses 10.

Figure 1:
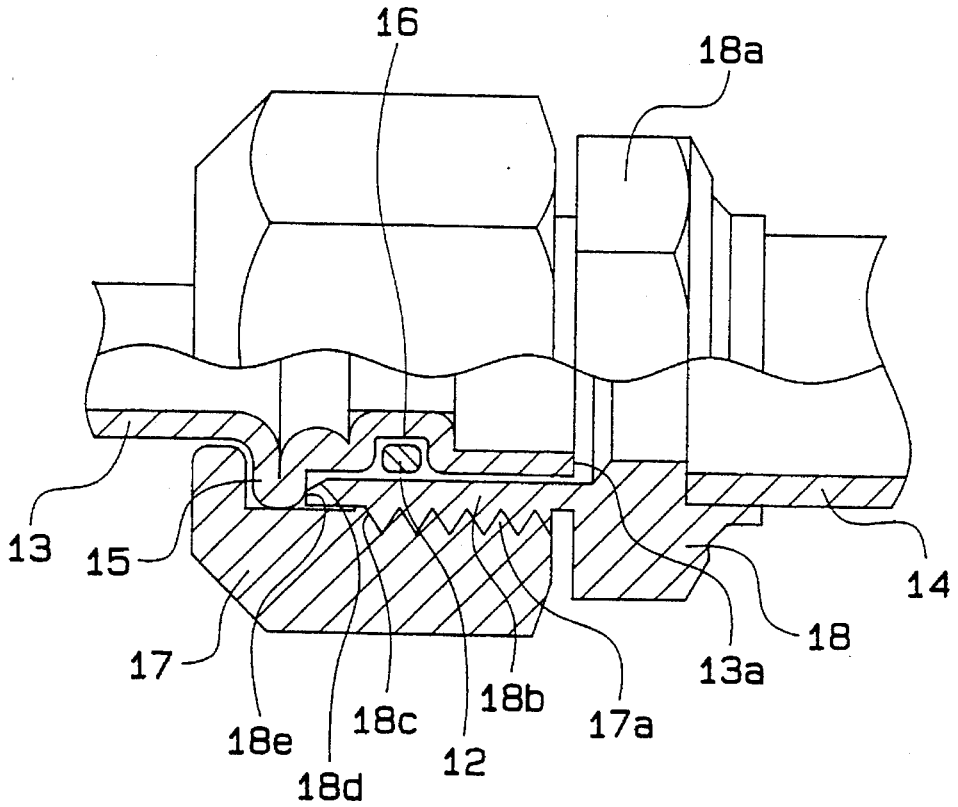
FIG. 1 is a partially cut away cross sectional view illustrating the condition of the connection of the pipe produced according to the present invention.
Figure 19:
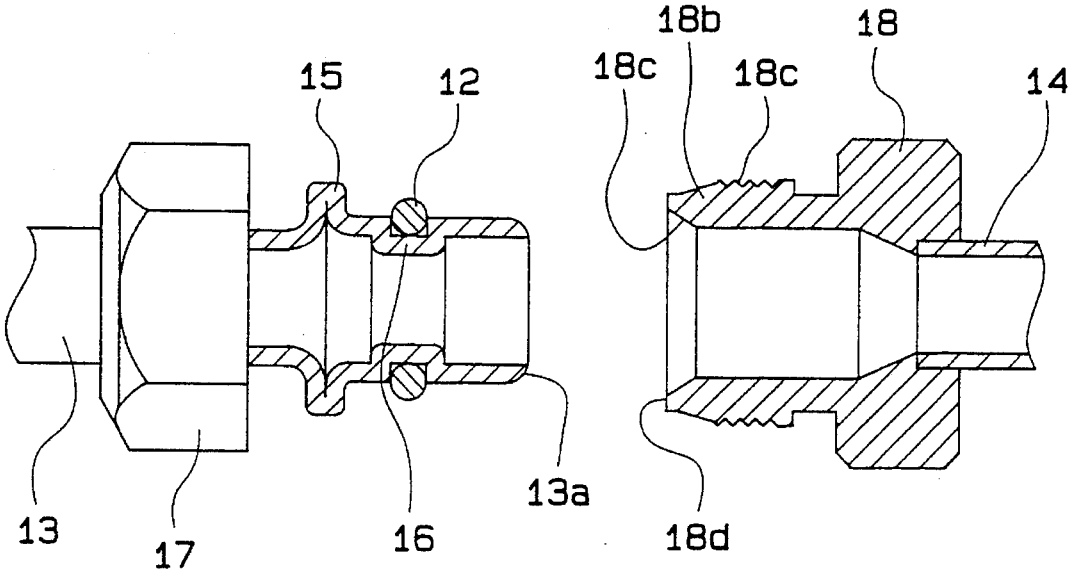
FIG. 19 is a partial cross-sectional view illustrating the condition of the male side pipe produced according to the present invention separated from the female side pipe.
Figure 20A:
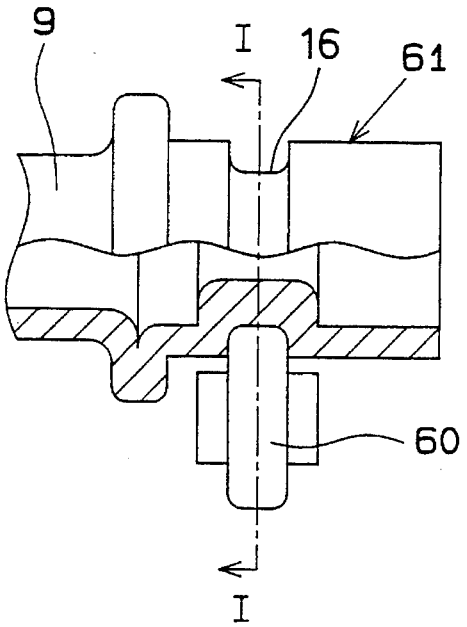
FIG. 20A PRIOR ART
FIG. 20A is a schematic view illustrating a conventional spinning process.
Figure 20B:
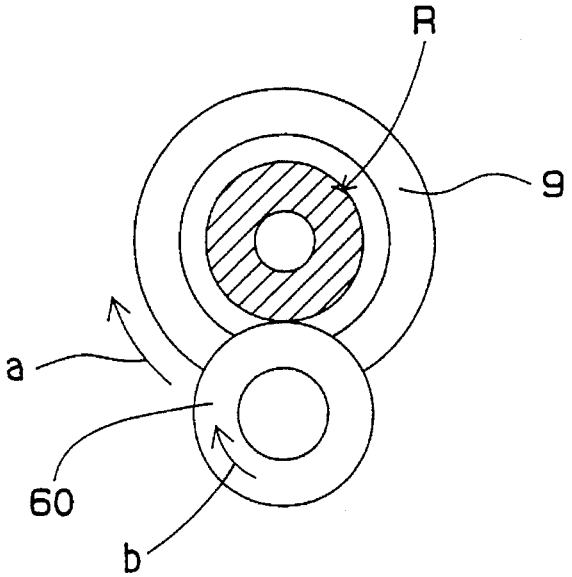
FIG. 20B is a cross-sectional view taken along line I—I in FIG. 20A.

FIG. 1 is a cut-away cross-sectional view illustrating the condition of male side pipe 13 and female side pipe 14 connected to each other. FIG. 19 is a partial cross-sectional view illustrating the condition of male side pipe 13 and female side pipe 14 separated from each other.

Male side pipe 13 is provided with annular bead part (i.e. bulge part) 15 on the outer periphery at the side of pipe tip end 13*a*, the right side in FIG. 1, and also includes annular seal groove 16 for holding O-ring 12 at the side of tip end 13*a* from bead part, 15. Male side pipe 13 is normally composed of a material pipe made of a metal such as aluminum, copper, brass, stainless steel or iron, to achieve the sealability at the connecting portion, and aluminum A3003 is used in the embodiment. It is to be noted that male side pipe 13 corresponds to the "pipe" referred to in the appended claims, with tip end 13*a* corresponding to "the tip end of the pipe" in the claims, bulge part 15 corresponding to the "bulge-shaped portion" referred to in the claims, and seal groove 16 corresponding to the "groove" referred to in the claims.

Here, O-ring 12 has a doughnut-like ring shape with a circular cross section. O-ring 12 is made of an elastic material such as rubber, and RBR (rubber ready for both R12 and R134 fleons) of 1.8 mm in cross-section diameter is used in this embodiment.

On the outer periphery of male side pipe 13 is mounted nut 17 at the rear side, i.e. the left side in FIG. 1, from bead part 15. Nut 17 is also made of a metal material, and aluminum A6061 is used in this embodiment.

Female side pipe 14 is normally made of metal pipe material like male side pipe 13, and aluminum A3003 is used in this embodiment.

At the tip end part of female side pipe 14, union 18 having a hexagon head part 18*a* is provided. Union 18 is provided with a cylindrical part 18*b* fitting over the outer periphery of the male side pipe 13 through O-ring 12 at the side of tip end, i.e. the left side in FIG. 1, from the hexagon head part 18*a*. On the outer periphery of cylindrical part 18*b*, external thread 18*c* is formed for screw coupling with an internal thread 17*a* of the 17. At the tip end of cylindrical part 18*b*, tip end part 18*e* is provided and at the inside diameter side of tip end part 18*e* is formed tapered part 18*d* to facilitate the fitting. The union 18 is also made of a metal material, and aluminum DA7N11 is used in this embodiment.

The female side pipe 14 and the union 18 are integrally brazed.

To connect the male side pipe 13 to the female side pipe 14, the cylindrical part 18*b* of the union 18 is fit over the outer periphery of male side pipe 13 having O-ring 12 within seal groove 16 formed on the outer periphery. Tip end face of the cylindrical part 18*b* is thrust in until the tip end face hits bead part 15.

Then, external thread 18c formed on the outer periphery of cylindrical part 18b is screwed with the internal thread 17a formed on the inner periphery of nut 17 to combine the cylindrical part 18b and nut 17, so that male side pipe 13 and female side pipe 14 are connected to each other.

Next, the method for producing the male side pipe 13 according to the present invention will be described.

Figure 10:
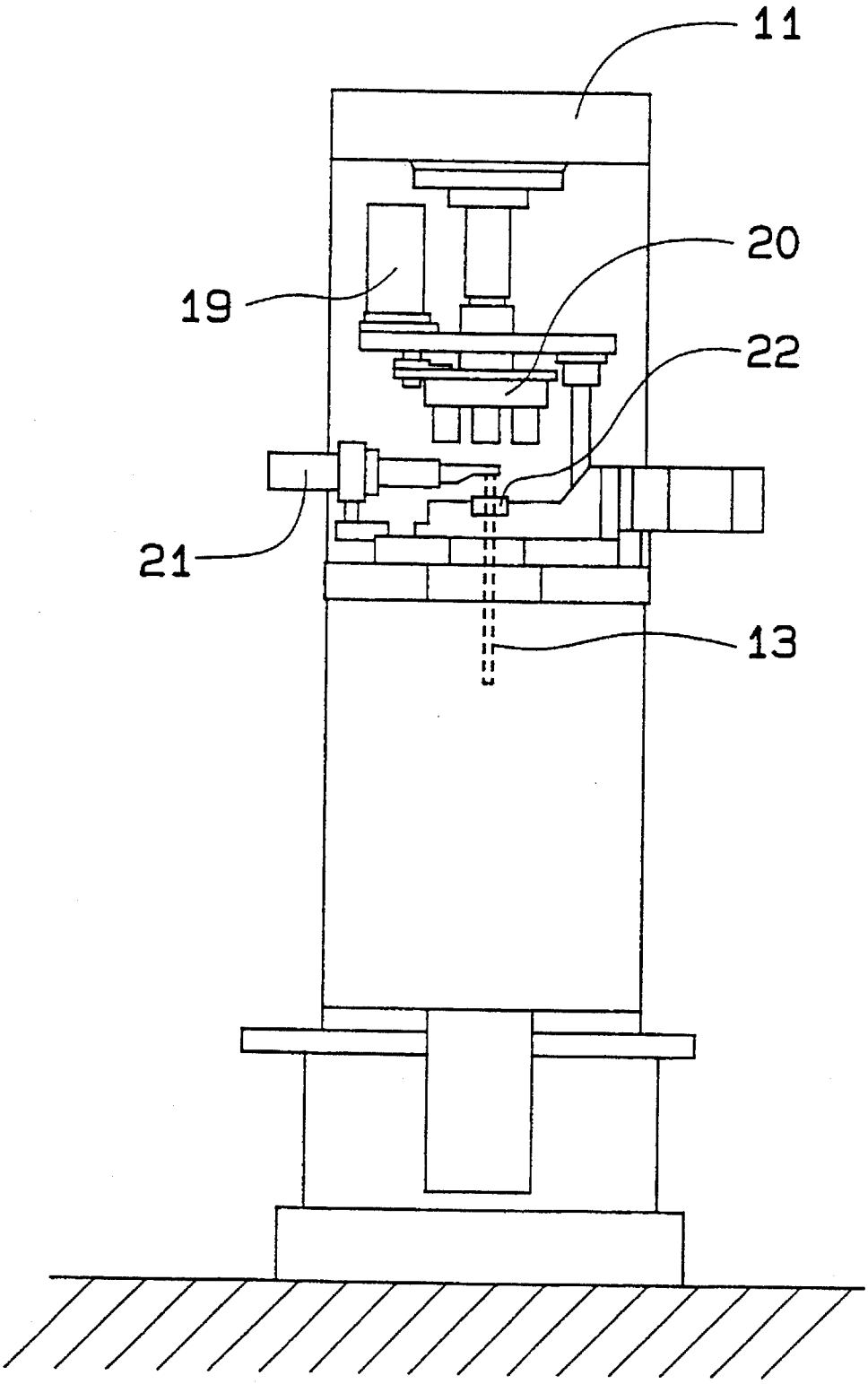
FIG. 10 is a schematic view illustrating a press used to manufacture the present invention.
Figure 11:
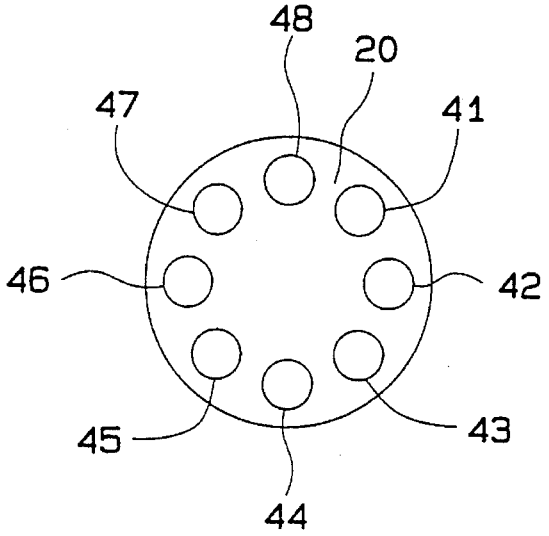
FIG. 11 is a bottom of a bulge punch table shown in FIG. 10.

FIG. 10 illustrates the outline of press (bulge making machine) 11. Press 11 is equipped with chuck 22 for holding male side pipe 13, stopper 21 for adjusting the setting height of male side pipe 13, bulge punch table 20 including bulge punches 41 through 48 (FIG. 11) for press machining male side pipe 13, and punch index motor 19 for turning bulge table 20. As illustrated in FIG. 11, bulge punch table 20 has eight pieces of punches from first punch 41 to eighth punch 48 at the same distance from the center of the bulge punch table 20.

A material pipe to be machined is cut to the specified length by a pipe cutter, a metal saw, a lathe or the like. Then, the material pipe is deburred (by means of chamfering, etc.), and set with a nut 17 thereon to form male side pipe 13.

Then, male side pipe 13 is clamped by chuck 22 attached to press 11. At this time, the setting height of male side pipe 13 is adjusted by stopper 21.

After the above, the stopper 21 is retreated.

Next, description will be given to the procedure for forming a cylindrical seal shape of male side pipe 13 by using bulge punches 41 through 48. FIGS. 21 through 28 illustrate the pipe machining by the operation of bulge punch table 20 which composes a die part of the press 11. In each of these figures, the left side from the center line illustrates the condition of the pipe under machining, and the right side from the center line illustrates the last condition of the press machining.

Here, bulge punch table 20 composing a die part will be described. Bulge punch table 20 holds and comprises eight pieces of punches, each of which is illustrated in FIGS. 29 through 36 respectively.

Figure 29:
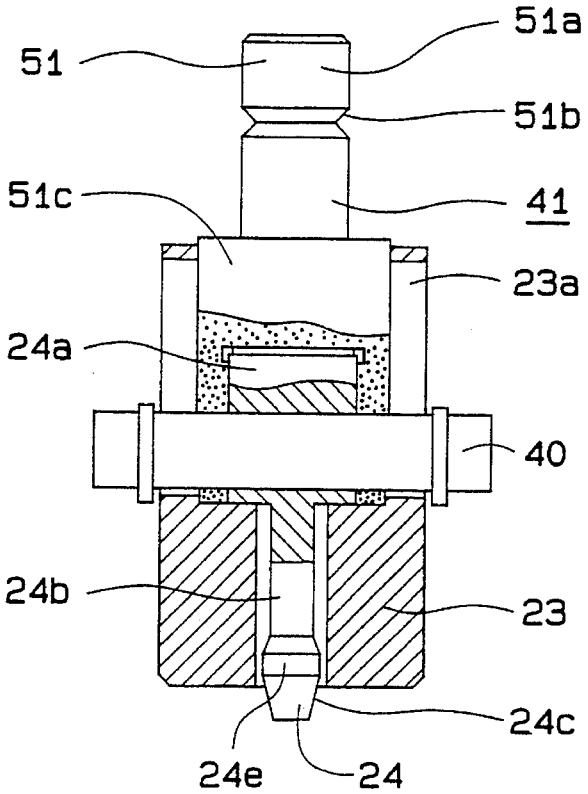
FIG. 29 is a cross-sectional view illustrating the composition of the first punch.

FIG. 29 illustrates first punch 41 which includes holder 51 to be attached to bulge punch table 20, cylindrical outside punch 23 for guiding the outside of male side pipe 13, inside punch 24 for machining the inside of male side pipe 13, and bolt 40 connecting holder 51 to inside punch 24 for activating inside punch 24. Holder 51 further comprises cylindrical holding part 51a for attaching first punch 41 to bulge punch table 20, fixing part 51b for fixing first punch 41 to bulge punch table 20 and holder body 51c. Holder body 51c is in contact at the inside with inside punch 24 and is fixed by bolt 40. Holder body 51c contacts at the outside with outside punch 23. Outside punch 23 is provided with slot 23a for passing bolt 40 therethrough to the outside to ensure the vertical motion stroke of inside punch 24. Outside punch 23 is held to first punch 41 by slot 23a and bolt 40. Inside punch 24 comprises cylinder part 24a fixed to holder body 51c through bolt 40 and mandrel 24b for internally machining the male side pipe. The tip portion of mandrel 24b is thinned with tapered part 24c inclined, at an angle between 15° and 25° in this embodiment, to the axial direction of mandrel 24b.

Figure 30:
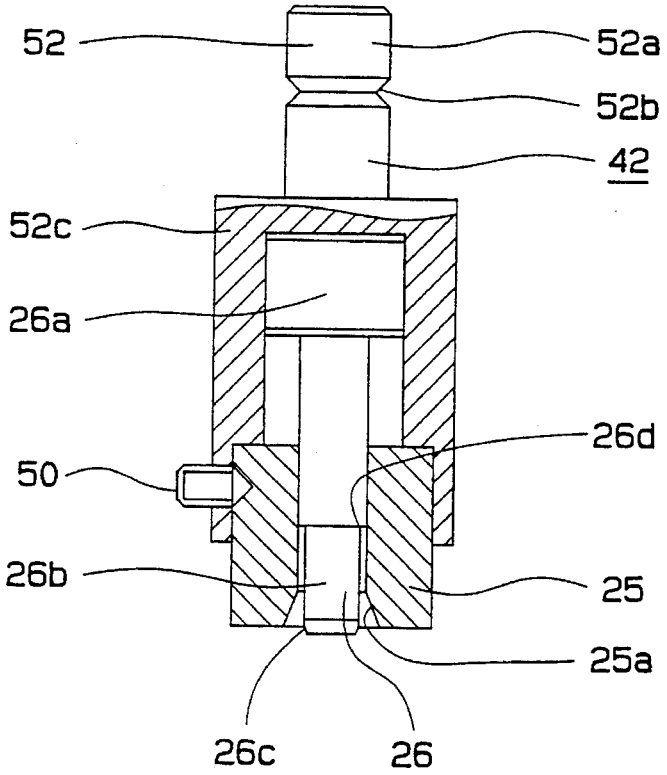
FIG. 30 is a cross-sectional view illustrating the composition of the second punch.

FIG. 30 illustrates second punch 42 which comprises holder 52 to be attached to bulge punch table 20, cylindrical outside punch 25 for pressing and drawing the outside of male side pipe 13, inside punch 26 for guiding the inside of male side pipe 13 and screw 50 for connecting holder 52 to outside punch 25. Holder 52 further comprises cylindrical holding part 52a for attaching second punch 42 to bulge punch table 20, fixing part 52b for fixing second punch 42 to bulge punch table 20, and holder body 52c. Holder body 52c is in contact at the inside with outside punch 25 and inside punch 26 and fixed to outside punch 25 by screw 50. Inside punch 26 is disposed at the inside of outside punch 25 and holder body 52c and held movably in the vertical direction. The lower part of cylindrical outside punch 25 has tapered part 25a, which is inclined at an angle of approximately 20° in this embodiment, expanding towards the outside from the center axis. Inside punch 26 further comprises cylinder part 26a disposed at the inside of outside punch 25 and holder body 52c and held movably in the vertical direction and mandrel 26b for internally guiding male side pipe 13. Tip portion of mandrel 26b is thinned with a tapered part 26c to facilitate insertion into the male side pipe 13. In an intermediate part of the mandrel 26b is formed level difference part 26d in contact with tip end 13a of male side pipe 13 to be machined.

Figure 31:
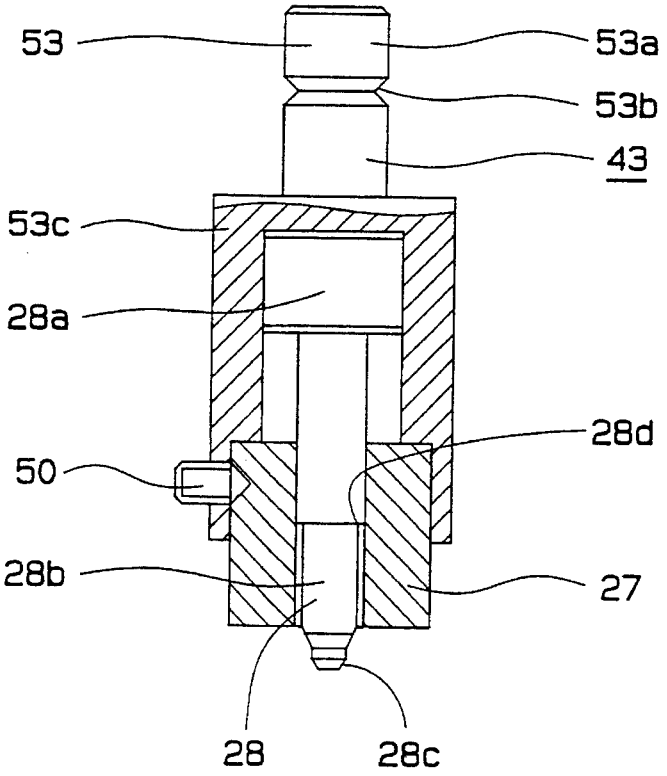
FIG. 31 is a cross-sectional view illustrating the composition of the third punch.

FIG. 31 illustrates third punch 43 which comprises holder 53 to be attached to bulge punch table 20, cylindrical outside punch 27 for pressing the bulge of male side pipe 13 towards the outside, an inside punch 28 for guiding the inside of male side pipe 13 and a screw for connecting holder 53 to outside punch 27. Holder 52 further comprises cylindrical holding part 53a for attaching third punch 43 to bulge punch table 20, fixing part 53b for fixing third punch 43 to bulge punch table 20 and holder body 53c. Holder body 53c is interior contact with outside punch 27 and inside punch 28 and is fixed to outside punch 27 by screw 50. Inside punch 28 is disposed at the inside of outside punch 27 and holder body 53c and held movably in the vertical direction. Inside punch 28 further comprises cylinder part 28a disposed at the inside of outside punch 27 and holder body 53c and held movably in the vertical direction and mandrel 28b for internally guiding male side pipe 13. The tip portion of mandrel 28b is thinned with a tapered part 28c to facilitate insertion into male side pipe 13. In an intermediate part of mandrel 28b is formed level difference part 28d in contact with tip end 13a of the male side pipe 13 to be machined.

Figure 32:
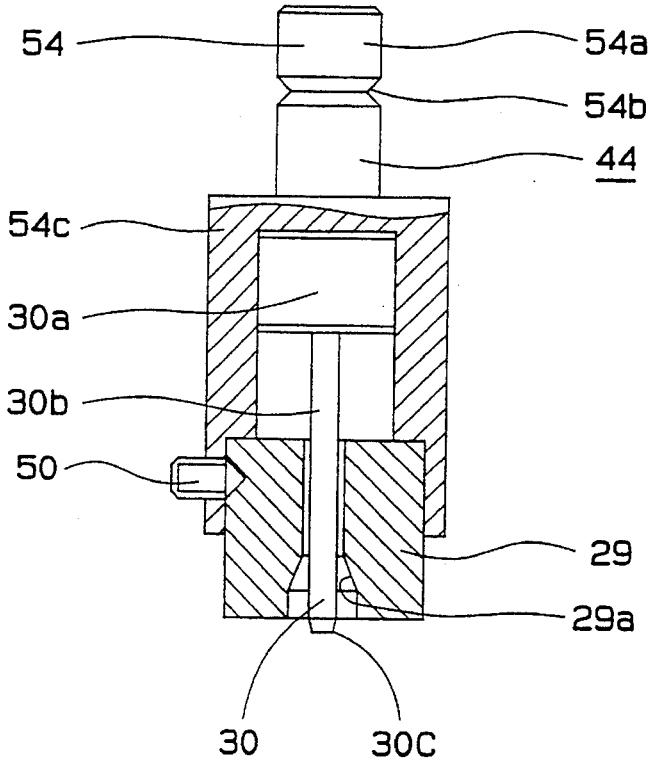
FIG. 32 is a cross-sectional view illustrating the composition of the fourth punch.

FIG. 32 illustrates fourth punch 44 which comprises holder 54 to be attached to bulge punch table 20, cylindrical outside punch 29 for pressing the outside of male side pipe 13 for contraction, inside punch 30 for guiding the inside of male side pipe 13 and screw 50 for connecting holder 54 to outside punch 29. Holder 54 further comprises cylindrical holding part 54a for attaching fourth punch 44 to bulge punch table 20, fixing part 54b for fixing fourth punch 44 to bulge punch table 20 and holder body 54c. Holder body 54c is in contact at the inside with outside punch 29 and inside punch 30 and is fixed to outside punch 29 by screw 50. Inside punch 30 is disposed at the inside of outside punch 29 and holder body 54c and is held movably in the vertical direction. In a lower part of cylindrical outside punch 29 and slightly above the lower end thereof, with a distance between 3 mm and 6 mm from the lower end of the outside punch 29 to the lower end of the tapered part 29a in this embodiment, tapered part 29a is formed, which expands towards the outside. In this embodiment, tapered part 29a is inclined at an angle between 15° and 30° from the center axis. Inside punch 30 further comprises cylinder part 30a disposed at the inside of outside punch 29 and holder body 54c and held movably in the vertical direction and mandrel 30b for internally guiding male side pipe 13. The tip portion of mandrel 30b is thinned with tapered part 30c to facilitate insertion into male side pipe 13.

Figure 33:
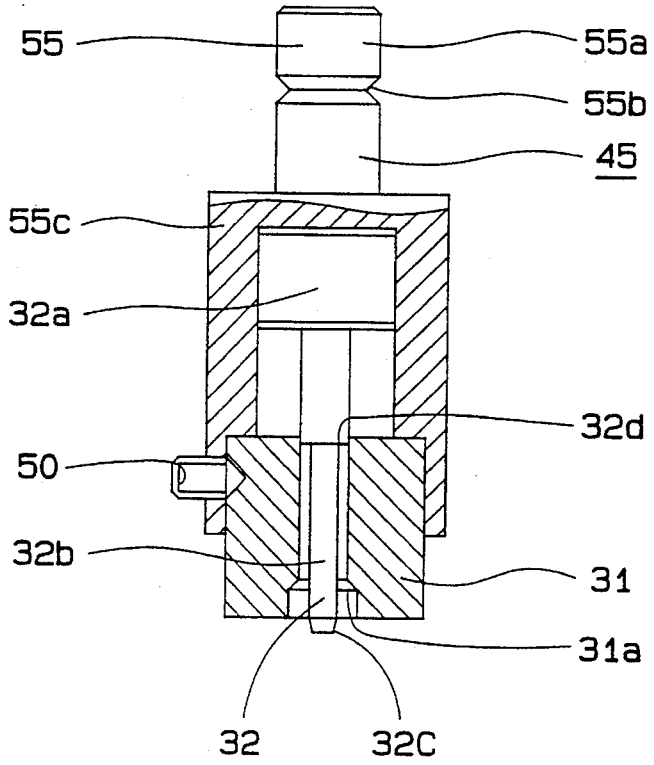
FIG. 33 is a cross-sectional view illustrating the composition of the fifth punch.

FIG. 33 illustrates fifth punch 45 which comprises holder 55 to be attached to bulge punch table 20, cylindrical outside punch 31 for pressing the outside of male side pipe 13 for contraction, inside punch 32 for guiding the inside of male side pipe 13 and screw 50 for connecting holder 55 to outside punch 31. Holder 55 further comprises cylindrical holding part 55*a* for attaching fifth punch 45 to bulge punch table 20, fixing part 55*b* for fixing the fifth punch 45 to bulge punch table 20 and holder body 55*c*. Holder body 55*c* is in contact at the inside with outside punch 31 and inside punch 32 and is fixed to outside punch 31 by screw 50. Inside punch 32 is disposed at the inside of outside punch 31 and holder body 55*c* and held movably in the vertical direction. In a lower part of cylindrical outside punch 31 and slightly above the lower end thereof, with a distance between 3 mm to 6 mm from the lower end of outside punch 31 to the lower end of the tapered part 31*a* in this embodiment, tapered part 31*a* expands towards the outside, inclined at an angle of 45° in this embodiment, from the center axis. Inside punch 32 further comprises cylinder part 32*a* disposed at the inside of outside punch 31 and holder body 55*c* and held movably in the vertical direction and mandrel 32*b* for internally guiding male side pipe 13. The tip portion of mandrel 32*b* is thinned with tapered part 32*c* to facilitate insertion into male side pipe 13. In an intermediate part of mandrel 32*b*, a level difference part 32*d* contacts with tip end 13*a* of male side pipe 13 to be machined.

Figure 34:
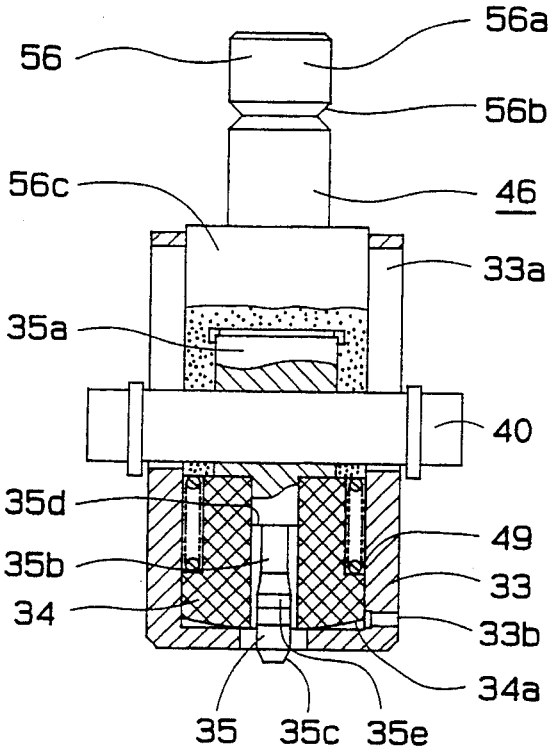
FIG. 34 is a cross-sectional view illustrating the composition of the sixth punch.

FIG. 34 illustrates sixth punch 46 which comprises holder 56 to be attached to bulge punch table 20, a cylindrical intermediate punch 34 and cylindrical outside punch 34 both for guiding the outside of male side pipe 13, inside punch 35 for machining the inside of male side pipe 13 and bolt 40 for connecting holder 56 to inside punch 35 for activating inside punch 35. Holder 56 further comprises cylindrical holding part 56*a* for attaching sixth punch 46 to bulge punch table 20, fixing part 56*b* for fixing sixth punch 46 to bulge punch table 20 and holder body 56*c*. Holder body 56*c* contacts at the inside with inside punch 35 and is fixed by bolt 40. Under the bolder body 56*c*, roughly cylindrical intermediate punch 34 is disposed. Holder body 56*c* is in contact at the outside with outside punch 33. Here, the intermediate punch 34 is disposed within the outside punch 33, and at the outside of the lower end portion of intermediate punch 34 is formed tapered part 34*a* to facilitate the release of the cutting oil. At the outside of the upper part of intermediate punch 34 is attached a spring 49. The tightening force of spring 49 makes it easy for intermediate punch 34 to move interlocked with outside punch 33. Outside punch 33 is provided with slot 33*a* for passing bolt 40 therethrough to the outside to ensure the vertical motional stroke of inside punch 35. Slot 33*a* and bolt 40 hold outside punch 33 to sixth punch 46. In a lower part of outside punch 33 is made escape port 33*b* to allow the cutting oil to be released. Inside punch 35 further comprises cylinder part 35*a* fixed to holder body 56*c* through bolt 40 and mandrel 35*b* for internally machining male side pipe 13. The tip portion of mandrel 35*b* is thinned with tapered part 35*c*. In an intermediate part of mandrel 35*b* is formed level difference part 35*d* that contacts tip end 13*a* of male side pipe 13 to be machined. Beneath level difference part 35*d* of mandrel 35*b* is formed land part 35*e* to reduce the thickness of male side pipe 13.

Figure 35:
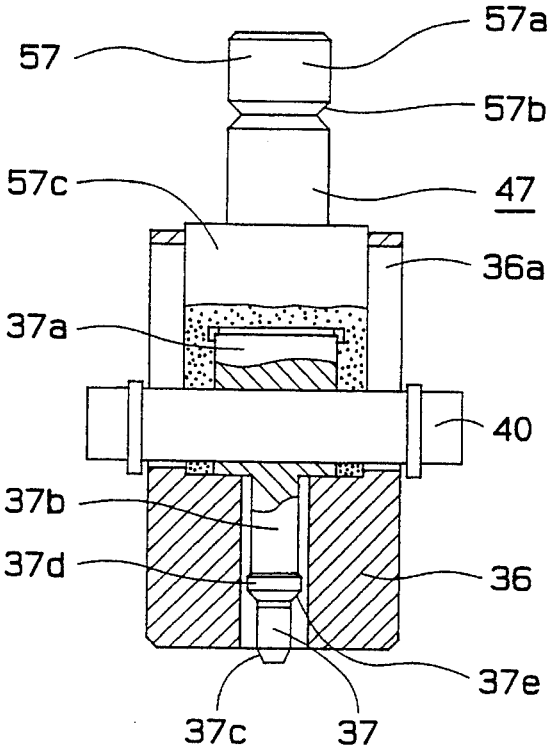
FIG. 35 is a cross-sectional view illustrating the composition of the seventh punch.

FIG. 35 illustrates seventh punch 47 which comprises holder 57 to be attached to bulge punch table 20, cylindrical outside punch 36 for guiding the outside of male side pipe 13, inside punch 37 for machining the inside of male side pipe 13 and bolt 40 for connecting holder 57 to inside punch 37 for activating inside punch 37. Holder 57 further comprises cylindrical holding part 57*a* for attaching seventh punch 47 to bulge punch table 20, fixing part 57*b* for fixing seventh punch 47 to bulge punch table 20 and holder body 57*c*. Holder body 57*c* is in contact at the interior thereof with inside punch 37 and fixed by bolt 40. Holder body 57*c* is in contact at the outside with outside punch 36. Outside punch 36 is provided with slot 36*a* for passing bolt 40 therethrough to the outside to ensure the vertical motional stroke of inside punch 37. Slot 36*a* and bolt 40 hold outside punch 36 to seventh punch 46. Inside punch 37 further comprises cylinder part 37*a* fixed to holder body 57*c* through bolt 40 and mandrel 37*b* for internally machining male side pipe 13. The tip portion of mandrel 37*b* is thinned in the axial direction of mandrel 37*b* with a tapered part 37*c*. In an intermediate part of mandrel 37*b*, land part 37*d* is formed with a large axial diameter for enlarging the inside diameter of male side pipe 13 to be machined. Under land part 37*d* is formed tapered part 37*e*, inclined at an angle between 35° to 50° in this embodiment.

Figure 36:
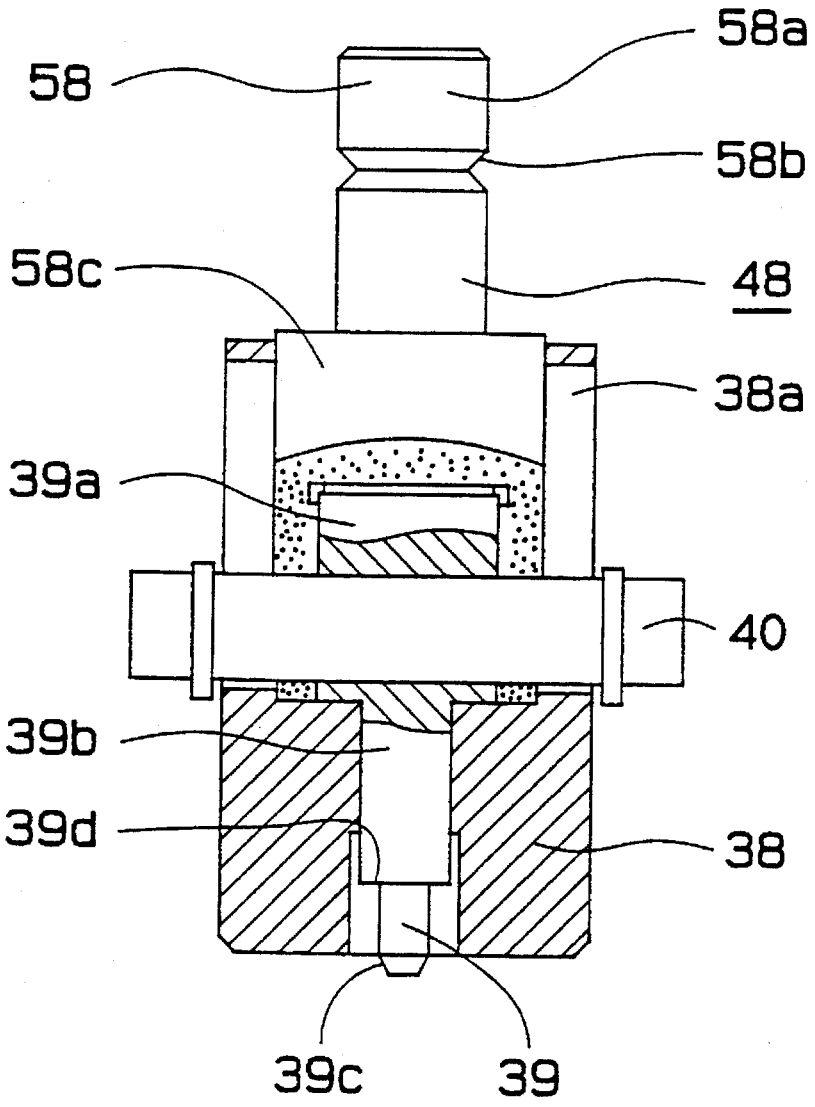
FIG. 36 is a cross-sectional view illustrating the composition of the eighth punch.

FIG. 36 illustrates eighth punch 48 which comprises holder 58 to be attached to bulge punch table 20, cylindrical outside punch 38 for guiding the outside of male side pipe 13, inside punch 39 for machining the inside of male side pipe 13 and bolt 40 for connecting holder 58 to inside punch 39 for activating inside punch 39. Holder 58 further comprises cylindrical holding part 58*a* for attaching eighth punch 48 to bulge punch table 20, fixing part 58*b* for fixing eighth punch 48 to bulge punch table 20 and holder body 58*c*. Holder body 58*c* contacts at the interior thereof with inside punch 39 and is fixed therewith by bolt 40. Holder body 58*c* contacts at the outside with outside punch 38. Outside punch 38 is provided with slot 38*a* for passing bolt 40 therethrough to the outside to ensure the vertical motional stroke of inside punch 39. Slot 38*a* and bolt 40 hold outside punch 38 to eighth punch 48. Inside punch 38 further comprises cylinder part 39*a* fixed to holder body 58*c* through bolt 40 and mandrel 39*b* for internally machining male side pipe 13. The tip portion of mandrel 39*b* is thinned in the axial direction of mandrel 39*b* with tapered part 39*c*. In an intermediate part of the mandrel 39*c*, level difference part 39*d* is formed for pressing the inside of male side pipe 13 to shape an intermediate part of male side pipe 13 at a roughly right angle to the axial direction of mandrel 39*b*.

The shapes of the first punch 41 through the eighth punch 48 have been described above. In the above, different punches are used but each punch may be of the same shape or with the same components.

Next, a detailed description of the operational principle behind bulge punch table 20 and the change in shape of male side pipe 13 to be machined.

First, by driving punch index motor 19 depicted in FIG. 10, bulge punch table 20 is turned, and first punch 41 (FIG. 11) is set above male side pipe 13.

Figure 21:
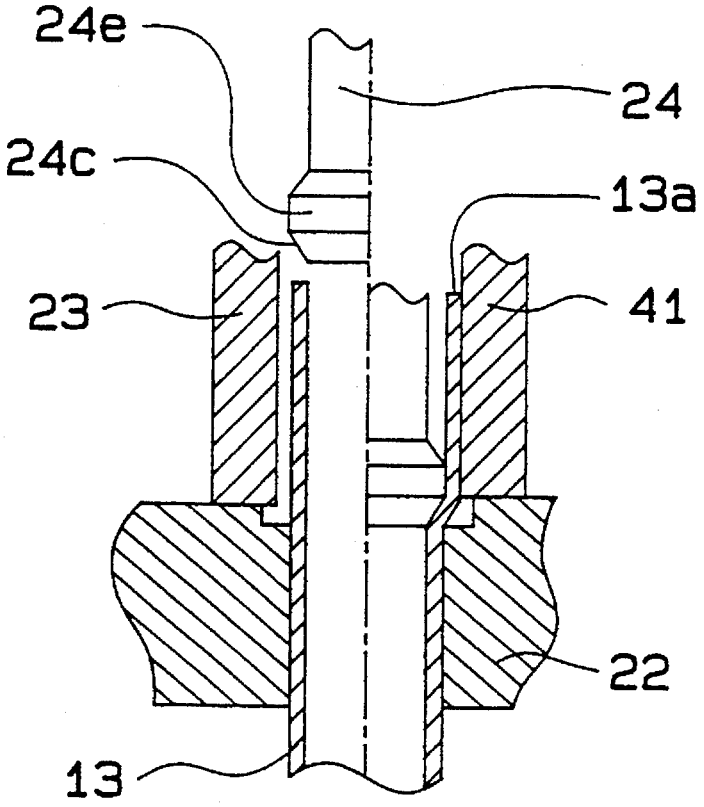
FIG. 21 is a pipe machining view illustrating the first step of the method according to the present invention.

In the first process, referred to as a "pipe widening process", illustrated in FIG. 21, first punch 41 lowers until outside punch 23, the inner diameter of which is larger than the outer diameter of male side pipe 13, contacts the chuck 22. Here, outside punch 23 serves as a guide for determining outside diameter of pipe 13 held by chuck 22. Next, inside punch 24 is lowered. Inside punch 24 is provided with tapered part 24*c*, which is inclined at an angle of 15° to 25° to the axial direction of male side pipe 13 and land part 24*e*, at the tip portion. The diameter of tapered part 24*c* is larger than the inside diameter of male side pipe 13. At this time, male side pipe 13 is widened by tapered part 24*c* in the part of the pipe disposed above chuck 22. Then, first punch 41 lifts to complete the first process.

Here, in this embodiment, a case was described where male side pipe 13 was widened first and then the next process was started so that the bulge could easily be formed. However, the pipe widening process, may be incorporated into the next process.

Driving punch index motor 19, the bulge punch table 20 is turned, and second punch 42 is set above male side pipe 13.

Figure 22:
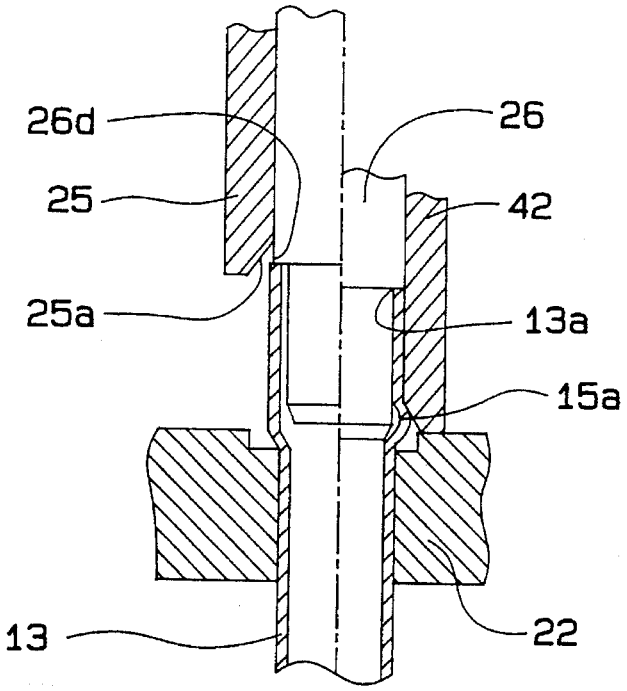
FIG. 22 is a pipe machining view illustrating the second step of the method according to the present invention.

In the second process, referred to as the "pipe bulging process", illustrated in FIG. 22, second punch 42 lowers, and inside punch 26 is inserted into male side pipe 13 to secure, i.e. guide, the inside diameter of male side pipe 13 widened in the first process. Next, outside punch 25 is lowered. Outside punch 25 is provided with tapered part 25*a* at the inner diameter side thereof disposed on the side of outside punch 25 that contacts chuck 22. Tapered part 25*a* is inclined at an angle of approximately 20° to the axial direction of male side pipe 13 and has an inner diameter slightly smaller than the outer diameter of male side pipe 13. Male side pipe 13 is contracted to the specified length to form bulged part 15*a*, also referred to as an "expanded part", at the side of male side pipe above chuck 22. The degree of expansion of bulged part 15*a* is determined by the inclination of the tapered part 25*a*. Then, second punch 42 lifts to complete the second process.

Then, by driving punch index motor 19, the bulge punch table 20 is turned, and third punch 43 is set above male side pipe 13.

Figure 23:
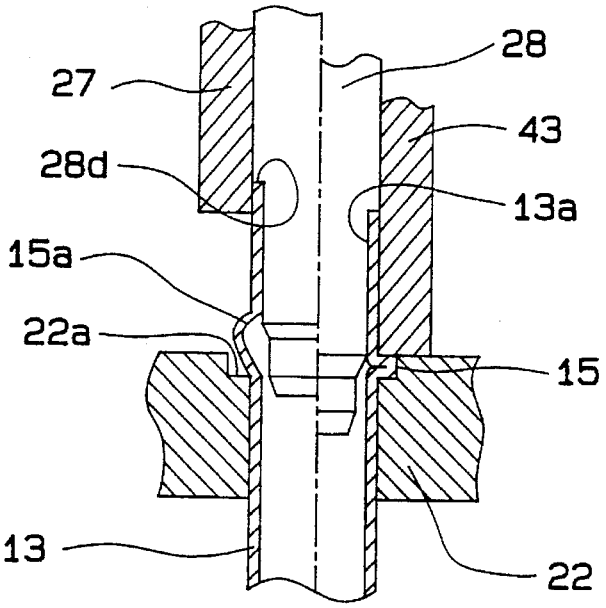
FIG. 23 is a pipe machining view illustrating the third step of the method according to the present invention.

In the this process, also referred to as the "pipe expanding process", illustrated in FIG. 23, third punch 43 lowers. Inside punch 28 is inserted into male side pipe 13 to secure, i.e. guide, the inside diameter of male side pipe 13. Outside punch 27, the inside diameter of which is almost equal to the outer diameter of male side pipe 13, is lowered. Bulged part 15*a* formed in the second process is pressed by the outside punch 27 and thrust into bulge shaping groove 22*a* provided in chuck 22, whereby bulge part 15 with a bulge shape is formed. Then, third punch 43 lifts to complete the third step.

Following the removal of third punch 43, by driving of punch index motor 19, bulge punch table 20 is turned, and fourth punch 44 is set above male side pipe 13.

Figure 24:
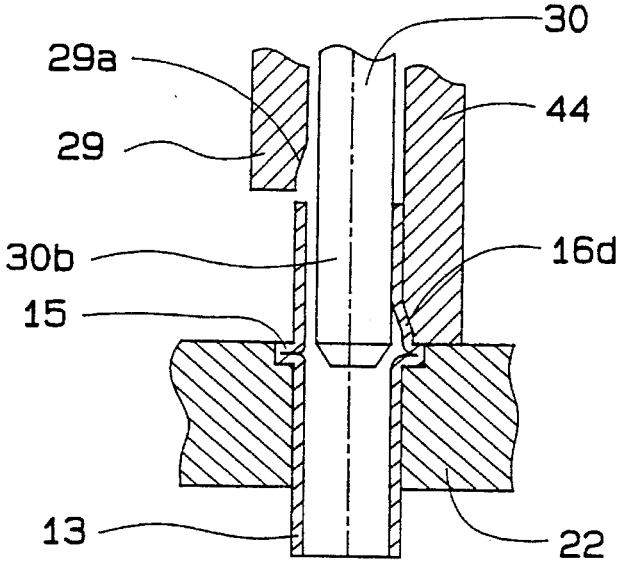
FIG. 24 is a pipe machining view illustrating the fourth step of the method according to the present invention.

In the fourth step, also referred to as the "first pipe contracting process", illustrated in FIG. 24, fourth punch 44 lowers. Inside punch 30 is inserted into male side pipe 13 to secure the inside diameter of male side pipe 13. Here, inside punch 30 is equipped with a mandrel 30*b*, the diameter of which is smaller than the inside diameter of male side pipe 13. Outside punch 29 is lowered until it contacts chuck 22. Here, outside punch 29 is provided with tapered part 29*a* at the inner side of outside punch 29 at the side that comes into contact with chuck 22. Tapered part 29*a* is inclined at an angle between 15° and 30° to the axial direction of male side pipe 13 and has an inside diameter smaller than the outside diameter of male side pipe 13. As tapered part 29*a* is located slightly above the lower end of outside punch 29, male side pipe 13 is contracted to the specified length in the portion from tip end 13*a* to an intermediate part of bulge part 15. Accordingly, the portion of male side pipe 13 for several millimeters slightly above bulge part 15 is not contracted, and between the contracted portion and the non-contracted portion is formed inclined face 16*d* along tapered part 29*a*, which corresponds to the "inclined face". Then, fourth punch 44 lifts to complete the fourth step.

Then, driving of punch index motor 19, bulge punch table 20 is turned, and fifth punch 45 is set above male side pipe 13.

Figure 25:
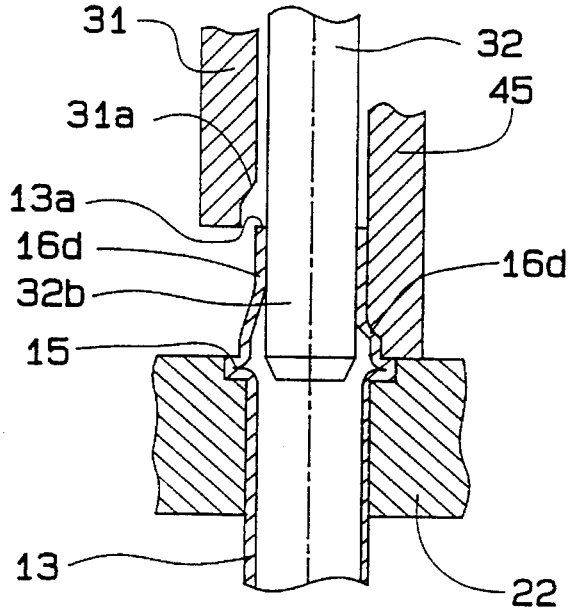
FIG. 25 is a pipe machining view illustrating the fifth step of the method according to the present invention.

In the fifth step, also known as the "second pipe contracting process", illustrated in FIG. 25, fifth punch 45 lowers. Inside punch 32 is inserted into male side pipe 13 to secure the inside diameter of male side pipe 13. Here, inside punch 32 is equipped with mandrel 32*b*, the diameter of which is almost equal to the inside diameter of male side pipe 13. Outside punch 31 is lowered until it contacts chuck 22. Here, outside punch 31 is provided with tapered part 31*a* at the inner side thereof at the side of outside punch 31 that contacts chuck 22. Tapered part 31*a* is inclined more steeply than is tapered part 29*a* used in the fourth step. Tapered part 31*a* inclines at an angle of approximately 45° to the axial direction of male side pipe 13 and has an interior diameter almost equal to the outer diameter of male side pipe 13. Between the portion contracted by the tapered part 31*a* and the non-contracted portion of male side pipe 13 is formed inclined face 16*d* along tapered part 31*a*. Then, fifth punch 45 lifts to complete the fifth step.

Here, in this embodiment, the process for contracting male pipe 13, also called a "pipe contracting process", is divided into the fourth and fifth steps described above, also called "first and second pipe contracting processes". However, the present invention may also be put into operation with the fourth step omitted, and contraction of the pipe may be performed utilizing only the fifth step.

When the fourth step is omitted, however, because the degree of plastic deformation caused by contracting male side pipe 13 is quite large, it is possible that male side pipe 13 may be seized up to outside punch 29 and, as a result, when outside punch 29 lifts, male side pipe 13 may also be broken. In order to prevent this problem from arising, it is advisable that the pipe contracting process should be divided into two separate steps as described above, if possible.

Next, by driving punch index motor 19, bulge punch table 20 is turned, and sixth punch 46 is positioned above male side pipe 13.

Figure 8:
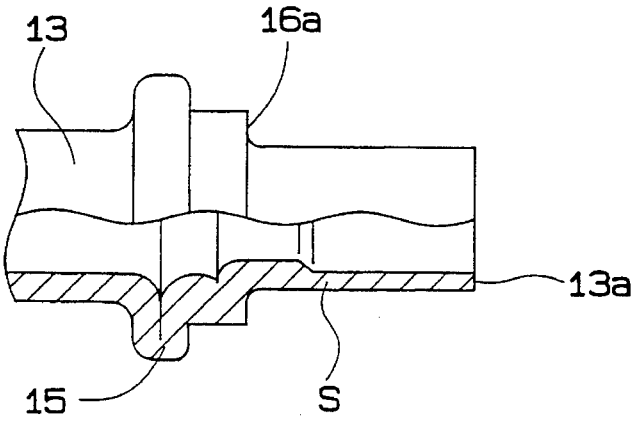
FIG. 8 is a partially cut away cross-sectional view illustrating a male side pipe after the groove forming process.
Figure 26:
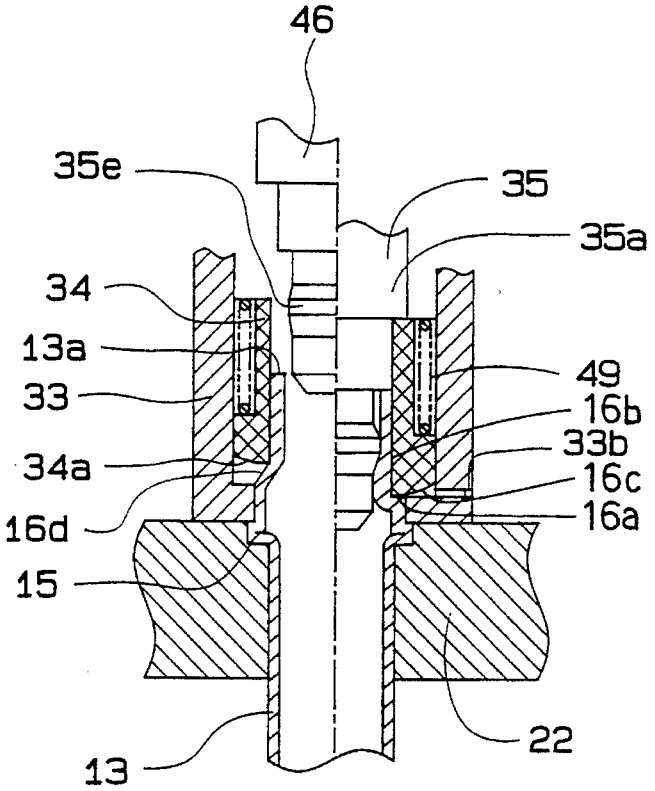
FIG. 26 is a pipe machining view illustrating the sixth step of the method according to the present invention.

In the sixth step, also referred to as a "groove reforming process", illustrated in FIG. 26, sixth punch 46 lowers until outside punch 33 for externally guiding the portion of male side pipe 13, which is at the side of tip end 13*a* and has not been contracted in the fourth and fifth steps, contacts the chuck 22. Here, outside punch 33 serves to determine the outer diameter of male side pipe 13 held by chuck 22. Intermediate punch 34, the inner diameter of which is almost equal to the outer diameter of the contracted portion of male side pipe 13, also lowers and is interlocked with outside punch 33 by the force of spring 49. Outside punch 33 and intermediate punch 34 stop when the lower end at the inside diameter of the intermediate punch 34 contacts the upper end, at the side of tip end 13*a*, of tapered inclined face 16*d* formed between the contracted portion and non-contracted portion of male side pipe 13. Here, intermediate punch 34 determines, i.e. guides, the outside diameter of the contracted portion of male side pipe 13. Inside punch 35 provided with land part 35*e*, the diameter of which is larger than the inner diameter of the contracted portion of male side pipe 13, is lowered. At this time, the thickness of male side pipe 13 is reduced by land part 35*e* for the portion from tip end 13*a* to an intermediate part of the contracted portion thereof. In this embodiment, a thickness of male side pipe 13 between 1.0 mm and 1.2 mm is reduced to a thickness between 0.9 mm and 1.15 mm. The cross-sectional view of male side pipe 13 machined through the first step to the sixth step is illustrated in FIG. 8. As the thickness of the portion from point S in this figure to tip end 13*a* is thinned, machining only on the thinned portion of male side pipe 13 can easily be performed. In addition, cylinder 35*a* of inside punch 35 presses intermediate punch 34, and pressed intermediate punch 34 presses tapered inclined face 16*d* formed between the contracted portion and the non-contracted portion. As a result, seal groove side face 16*a*, at the side of bulge part 15, formed roughly perpendicular to the axial direction of male side pipe 13 and seal groove bottom face 16*b* roughly parallel to the axial direction of male side pipe 13 are formed. Here, intermediate punch 34 is of a floating structure for the reason that release port 33*b* is provided to allow the cutting oil to flow from the portion between outside punch 33 and intermediate punch 34 and prevent the cutting oil from pooling in corner part 16*c* where male side pipe 13 contacts outside punch 33 and intermediate punch 34. Outside punch 34 may, as a result, have a curved face with the corners thereof being rounded. Then, sixth punch 46 lifts to complete the sixth step.

Here, in this embodiment, the pipe contracting process for the male side pipe 13 is broken into the fourth step, referred to as "first pipe contracting process", and the fifth step, referred to as "second pipe contracting process", before the sixth process, the "groove forming process", is performed However, the forth and sixth steps may be omitted and male side pipe 13 may be contracted only in the fifth step.

In the case where the fourth and sixth steps are omitted, however, because the degree of plastic deformation caused by contracting male side pipe 13 is large, male side pipe 13 may be seized up to outside punch 29 and, as a result, cracked or broken when outside punch 29 lifts. In addition, as it is difficult to form seal groove side face 16*a* at the side of bulge part 15 of male side pipe 13 to be roughly perpendicular to the axial direction of male side pipe 13, it is highly possible that the O-ring 12 intended to be set therein will be set askew within the seal groove 16, resulting in a defective seal. If tapered part 31*a* of outside punch 31 of fifth punch 45 is inclined at a larger angle, e.g., 50° to 85°, to the axial direction of male side pipe 13, in machining, seal groove side face 16*a* at the side of bulge part 15 will be inclined at a larger angle and, as a result, though O-ring 12 will be held more easily, the machining of male side pipe 13 will be more difficult, and male side pipe 13 may be seized up to outside punch 29 and cracked or broken more easily. In order to prevent this type of problems from arising, it is advisable that the pipe contracting process should be divided into three processes, i.e., the fourth through sixth steps as described above.

Next, by driving punch index motor 19, bulge punch table 20 is turned, and seventh punch 47 is set above the male side pipe 13.

Figure 27:
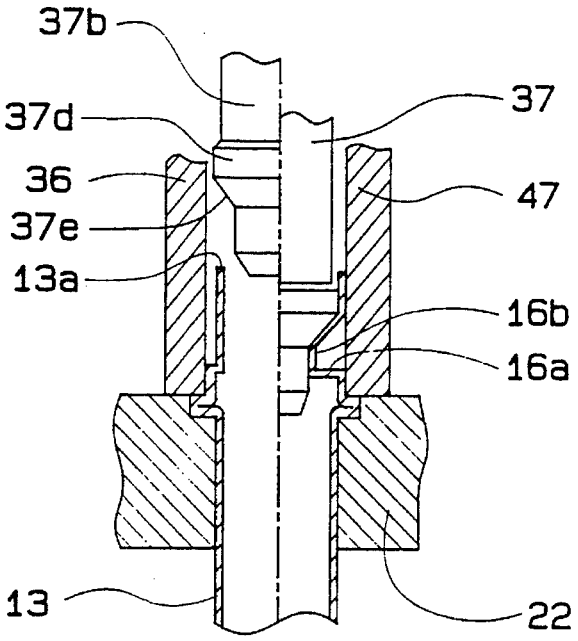
FIG. 27 is a pipe machining view illustrating the seventh step of the method according to the present invention.

In the seventh step, known as the "pipe widening process", illustrated in FIG. 27, seventh punch 47 lowers until outside punch 36 for externally guiding male side pipe 13 contacts chuck 22. Here, outside punch 36 serves to determine the outside diameter of male side pipe 13 held by chuck 22. Inside punch 37 is then lowered. Inside punch 37 is provided at an intermediate part of mandrel 37*b* with land part 37*d* and tapered part 37*e* inclined at an angle between 35° and 50° to the axial direction of mandrel 37*b* so as to expand, out of the contracted portion of male side pipe 13, the portion at the side of tip end 13*a* from seal groove side face 16*a*, i.e., the portion from point S in FIG. 8 to tip end 13*a*, i.e., the portion thinned in the sixth step. At this time, the width of seal groove bottom face 16*b*, i.e., the distance from seal groove side face 16*a* at the side of tip end 13*a* to seal groove side face 16*a* at the side of bulge part 15, is adjusted. In the present embodiment, the width of seal groove bottom face 16*b* is between about 2.5 mm and 5 mm. The width is adjusted by the depth of the insertion of inside punch 37. Then, seventh punch 47 lifts to complete the seventh step.

After completion of the seventh step, by driving punch index motor 19, bulge punch table 20 is turned, and the eighth punch 48 is positioned above male side pipe 13.

Figure 28:
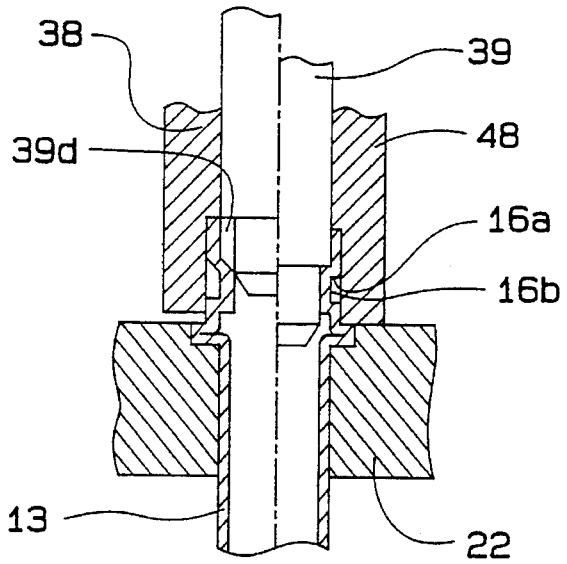
FIG. 28 is a pipe machining view illustrating the eighth step of the method according to the present invention.

In the eighth step, which is known as the "groove side face forming process", illustrated in FIG. 28, eighth punch 48 lowers until outside punch 38 for externally guiding male side pipe 13 contacts chuck 22. Here, outside punch 38 serve to determine the outside diameter of male side pipe 13 held by chuck 22. Inside punch 39 is then lowered. At this time, the inclined part of male side pipe 13 formed between the portion widened in the seventh step and seal groove bottom face part 16*b* is force pressed by level difference part 39*d* so that seal groove side face 16*a*, at the side of tip end 13*a*, perpendicular to the axial direction of the male side pipe 13 is formed. Accordingly, in this embodiment, the length of widened part 13*b* (illustrated in FIG. 18) has been formed to be between 6 mm and 9 mm. Then, eighth punch 48 lifts to complete the eighth step.

Here, in this embodiment, the widening process for male side pipe 13, also called the "pipe widening process" is followed by the eighth step, also called the "groove side face forming process". However, the eighth step may be omitted and seal groove side face 16*a*, at the side of tip end 13*a*, may be formed by the widening process only in the seventh step.

Also, in this case, however, as it is desirable that seal groove side face 16*a*, at the side of tip end 13*a*, should be machined to be at roughly a right angle to the axial direction of male side pipe 13, the degree of plastic deformation caused by the widening of the male side pipe 13 is large. Thus, it is possible that male side pipe 13 may be seized up to inside punch 39 and cracked or broken when inside punch 39 lifts. In order to prevent this trouble, it is advisable that the pipe widening process should be divided into two steps, i.e., the seventh step in which machining is performed to such an extent that seal groove side face 16*a* is inclined at an angle between 35° and 50° to the axial direction of male side pipe 13, and the eighth step in which machining is performed to make seal groove side face 16*a* roughly perpendicular to the axial direction of male side pipe 13.

Next, stopper 21 is activated to advance to the position above male side pipe 13.

Male side pipe 13, which has been machined through the above-described first through eighth steps, is removed by unclamping chuck 22.

This completes the machining for forming the material pipe into male side pipe 13.

The change in the thickness of the tip portion of machined pipe 13 after each step from the first through the eighth step is listed in Table 1 with three different sizes of male side pipe 13: one with an outside diameter of 8 mm and a plate thickness of 1.0 mm, one with an outside diameter of 0.5 in and a plate thickness of 1.2 mm and one with an outside diameter of ⅝ in and a plate thickness of 1.2 mm.

TABLE 1

| Outer diameter of pipe | 1st step | 2nd step | 3rd step | 4th step | 5th step | 6th step | 7th step | 8th step |
|---|---|---|---|---|---|---|---|---|
| D:8 mm | 0.95 | 0.965 | 0.99 | 1.175 | 1.2 | 0.9 | 0.76 | 0.785 |
| D:½ in | 1.1 | 1.175 | 1.2 | 1.325 | 1.35 | 1.15 | 1.035 | 1.06 |
| D:⅝ in | 1.2 | 1.2 | 1.225 | 1.325 | 1.35 | 1.15 | 0.95 | 0.975 |

Note:
Unit: mm, D: diameter, in: inch

Next, the second embodiment of the present invention will be described.

The second embodiment is a method of producing a bulge-shaped pipe in which the sixth step according to the first embodiment is modified.

Figure 12:
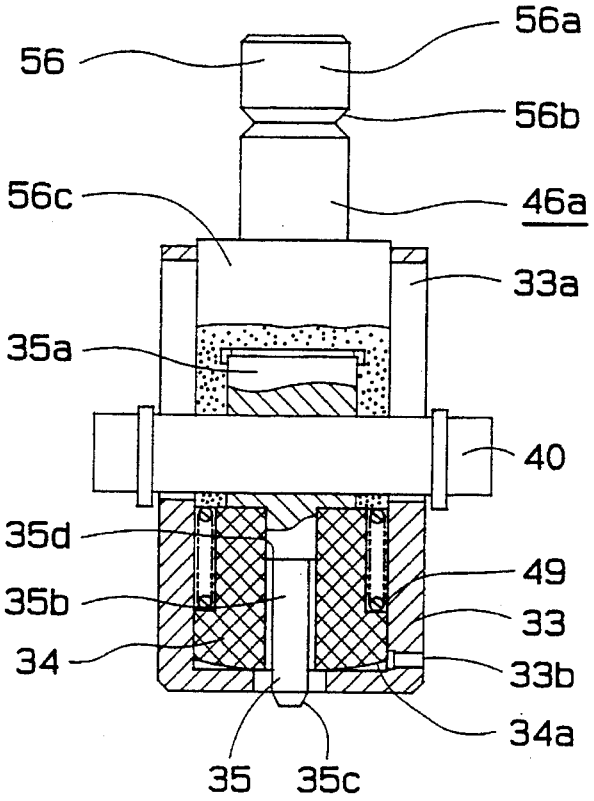
FIG. 12 is a view illustrating the structure of an alternate embodiment of the sixth punch.

The description is based upon the device pictured in FIG. 12, where sixth punch 46*a* of bulge punch table 20 is used.

Sixth punch 46*a* comprises a holder 56 to be attached to bulge punch table 20, cylindrical intermediate punch 34 and cylindrical outside punch 33, both of which are for guiding the outside of male side pipe 13, inner punch 35 for machining the inside of male side pipe 13 and bolt 40 for connecting holder 56 to inside punch 35 for activating inside punch 35. Holder 56 further comprises cylindrical holding part 56*a* for attaching sixth punch 46 to bulge punch table 20, fixing part 56*b* for fixing sixth punch 46 to bulge punch table 20 and holder body 56*c*. Holder body 56*c* is in contact at the inside with inside punch 35 and is fixed by bolt 40. Under holder body 56*c* is located roughly cylindrical intermediate punch 34. Holder body 56*c* is in contact at the outside with outside punch 33. Here, intermediate punch 34 is disposed within outside punch 33, and at the outside of the lower end portion of intermediate punch 34, tapered part 34*a* is formed to facilitate the release of the cutting oil. At the outside of the upper part of intermediate punch 34, spring 49 is attached. Intermediate punch 34 can easily be moved in an interlocking manner with outside punch 33 by the tightening force of spring 49. Outside punch 33 is provided with slot 33*a* for passing bolt 40 therethrough to the outside to ensure the vertical motional stroke of inside punch 35. Outside punch 33 is held to sixth punch 46 by slot 33*a* and bolt 40.

At a lower part of outside punch 33 is made a release port 33*b* for releasing the cutting oil. The inside punch 35 further comprises cylinder part 35*a* fixed to holder body 56*c* through bolt 40 and mandrel 35*b* for internally machining male side pipe 13. The tip portion of mandrel 35*b* is thinned along the axial direction of mandrel 35*b* with tapered part 35*c*. In an intermediate part of the mandrel 35*b*, a level difference part 35*d* in contact with tip end 13*a* of male side pipe 13 is formed.

Next, the operational principle of sixth punch 46*a* of bulge punch table 20 and the change in shape of male side pipe 13 machined will be described.

Figure 13:
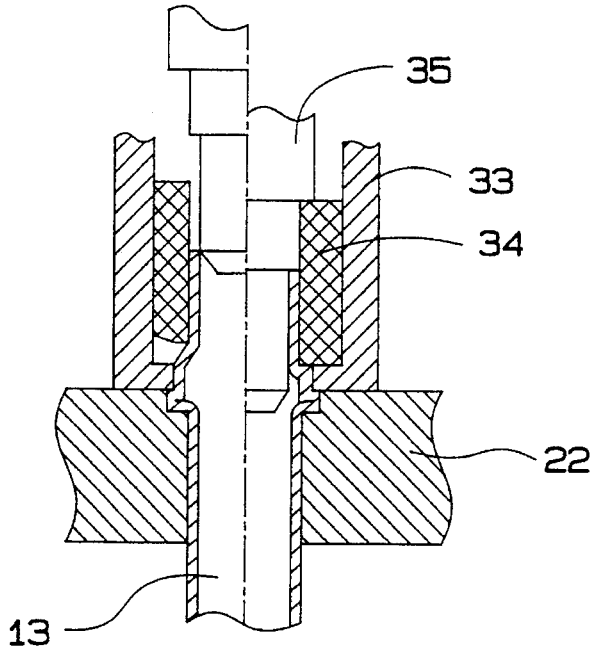
FIG. 13 is a pipe machining view illustrating the sixth step of the process in the alternate embodiment.

In the sixth step, also called the "groove forming process", illustrated in FIG. 13, sixth punch 46*a* lowers until the outside punch 33 for externally guiding the portion of male side pipe 13 which is at the side of tip end 13*a* from bulge part 15 and has not been contracted in the fourth step or the fifth step contacts chuck 22. Here, outside punch 33 serves to determine the outside diameter of male side pipe 13 held by chuck 22.

Intermediate punch 34, the inside diameter of which is almost equal to the outside diameter of the contracted portion of male side pipe 13, is also lowered in an interlocked state, with outside punch 33 by the force of spring 49. Intermediate punch 34 stops when the lower end at the side of the inside diameter of intermediate punch 34 contacts the upper end, at the side of the tip end 13*a*, of the tapered inclined part of male side pipe 13 formed between the contracted portion and the non-contracted portion. Here, intermediate punch 34 determines, i.e., guides, the outside diameter of the contracted portion of male side pipe 13.

Next, inside punch 35 provided with mandrel 35*b* whose diameter is almost equal to the inside diameter of the contracted portion of male side pipe 13 is lowered. At this time, cylinder 35*a* of inside punch 35 presses intermediate punch 34, and pressed intermediate punch 34 presses tapered inclined part formed between the contracted portion and the non-contracted portion. As a result, seal groove side face 16*a*, at the side of bulge part 15, formed roughly perpendicular to the axial direction of male side pipe 13 and seal groove bottom face 16*b* roughly parallel to the axial direction of male side pipe 13 are formed. Here, intermediate punch 34 is of a floating structure for the reason that a mechanism is provided which releases the machining oil from the portion between outside punch 33 and intermediate punch 34 to prevent the cutting oil from pooling in corner part 16*c* where the male side pipe 13 is in contact with the outside punch 33. Intermediate punch 34 may have a curve with a large curvature, i.e., corner rounding. Then, sixth punch 46*a* lifts to complete the sixth step.

Figure 3:
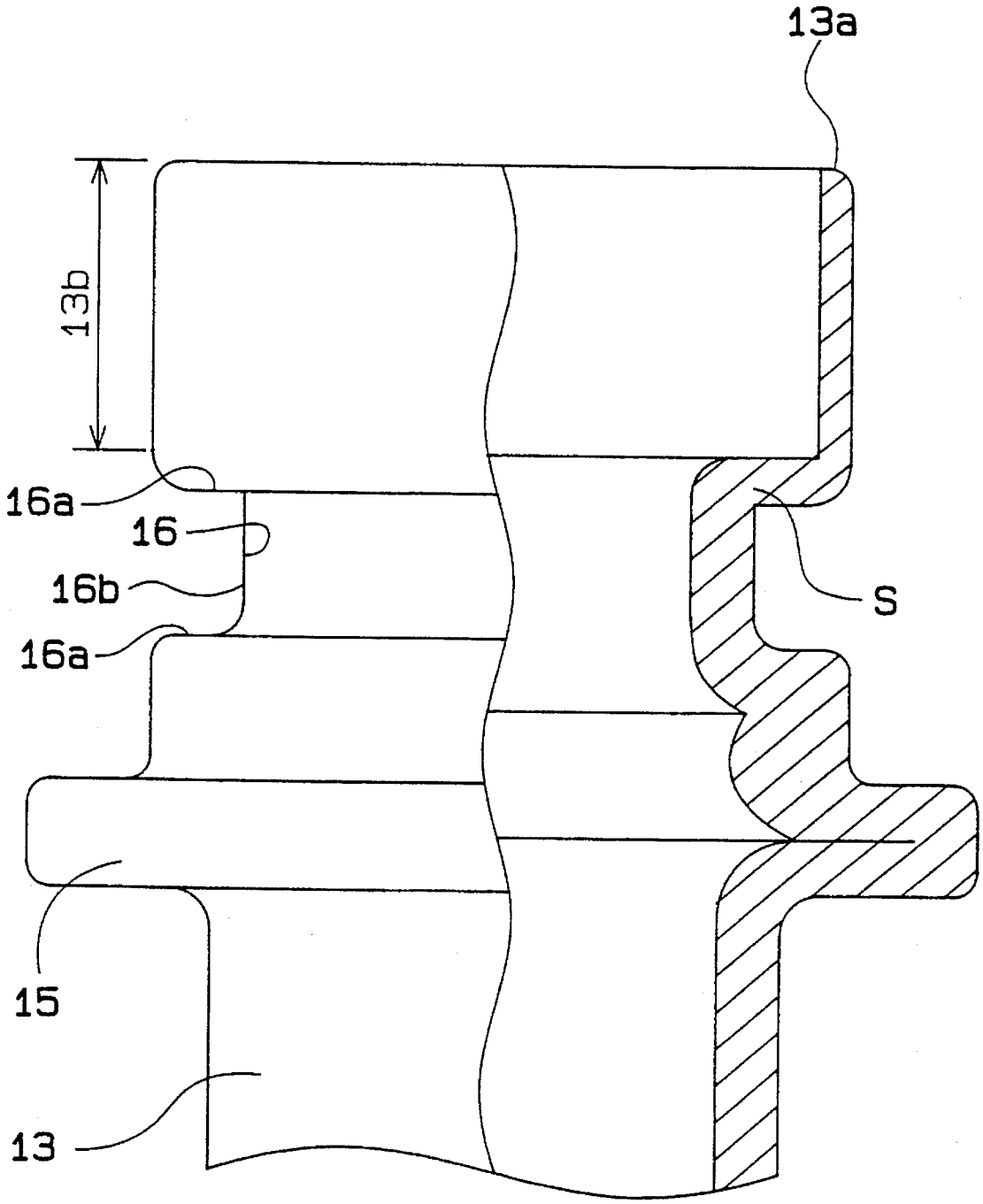
FIG. 3 is an enlarged, partially cut away cross sectional view showing the male side pipe according to the present invention.

Except for the above process, the same processes as those in the first embodiment are used for producing male side pipe 13 illustrated in FIG. 3.

However, as male side pipe 13 machined using the above procedure is not thinned in the sixth step, the "groove forming process", the machining of the portion of male side pipe 13 at the side of tip end 13 in the following processes is difficult. Accordingly, in some cases, it is difficult to make angle $\psi$ of seal groove side face 16*a* at side of tip end 13*a* to the axial direction of male side pipe 13 be roughly at right angles as illustrated in FIG. 4.

Figure 4:
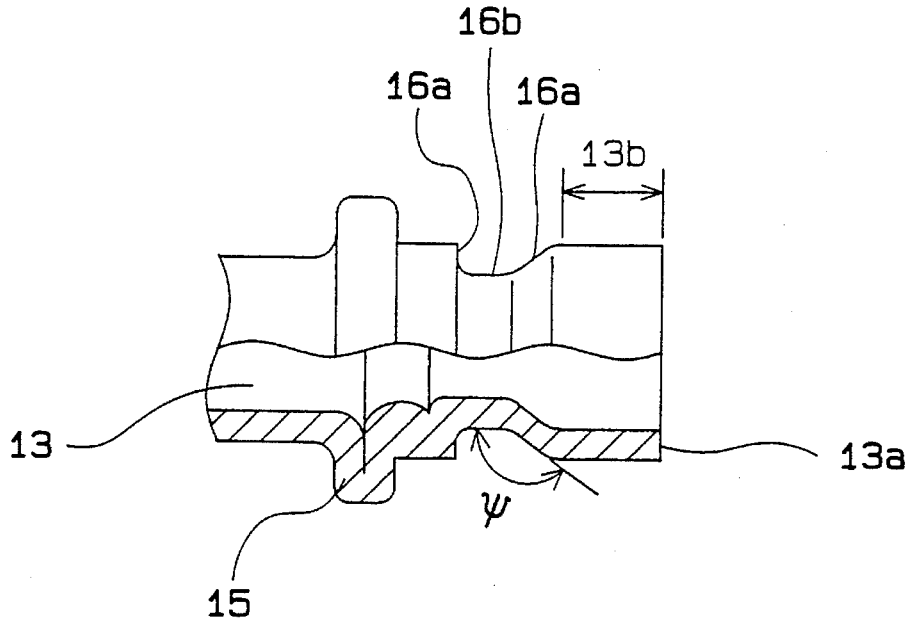
FIG. 4 is a partially cut away cross-sectional view illustrating the male side pipe produced according to the present invention.
Figure 14:
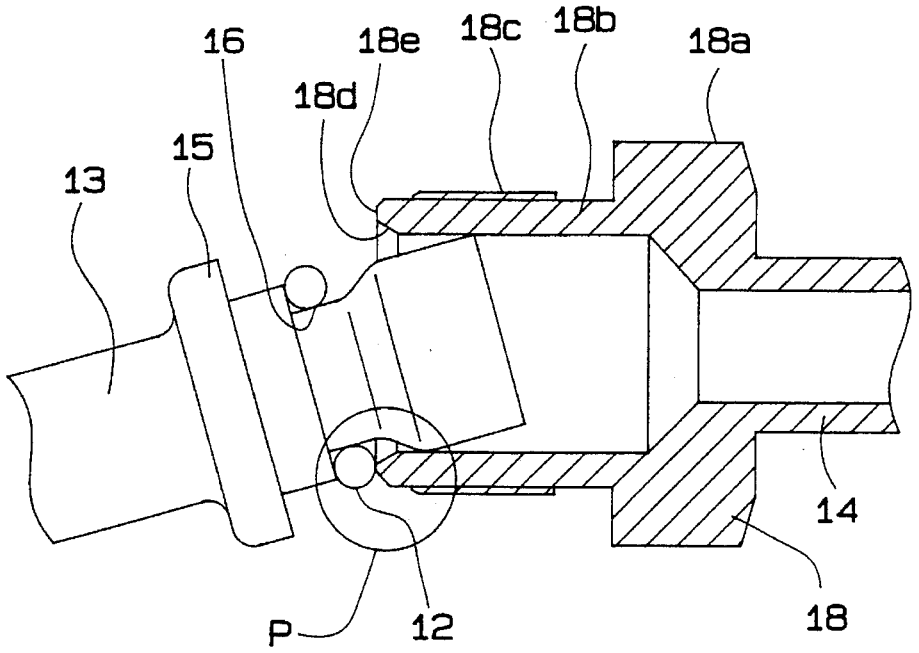
FIG. 14 is a view of the male side pipe manufactured according to the present invention being assembled with a female side pipe.
Figure 15:
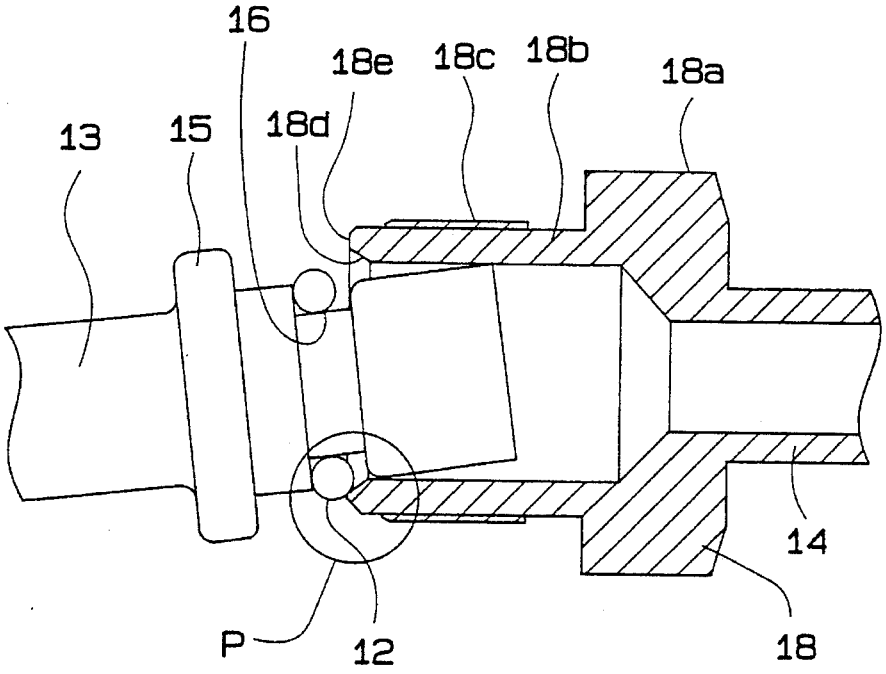
FIG. 15 is another view of the male side pipe manufactured according to the present invention being assembled with a female side pipe.
Figure 16:
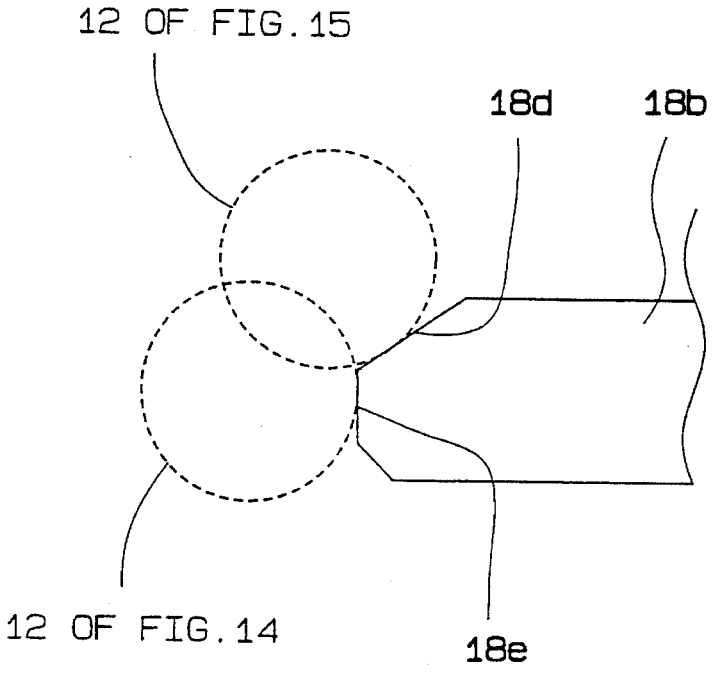
FIG. 16 is an enlarged view illustrating the point P in FIGS. 14 and 15.
Figure 17:
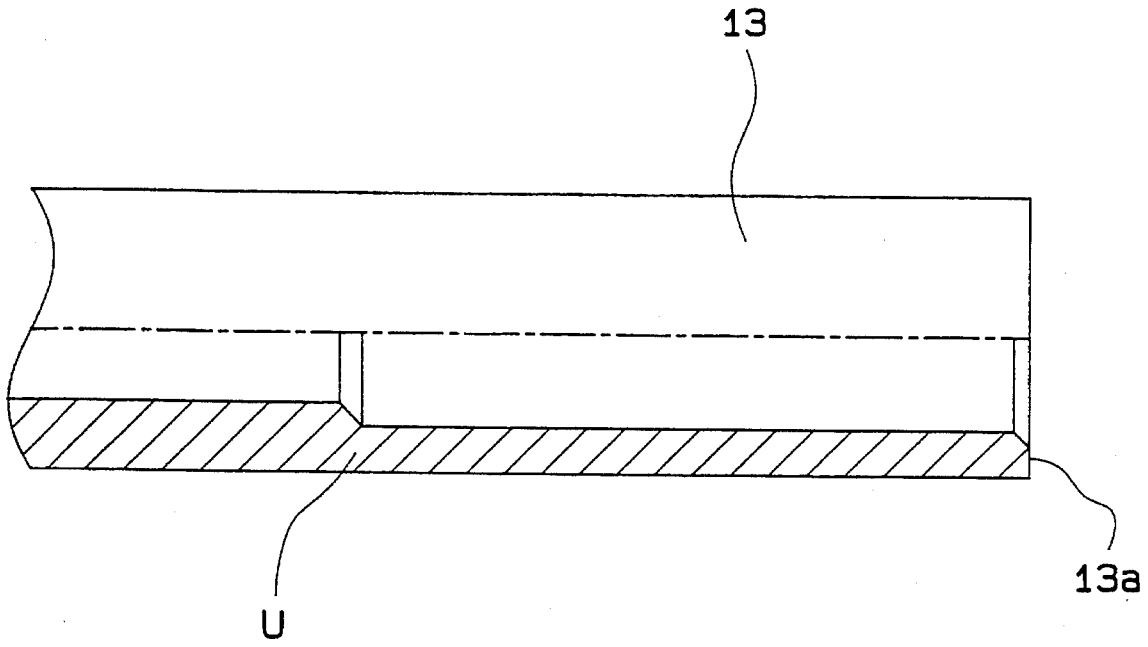
FIG. 17 is a partially cut away cross-sectional view illustrating the male side pipe after the cutting of the inside diameter.

Here, a case where male side pipe 13 illustrated in FIG. 4 is fitted into female side pipe 14 with the inclination bring illustrated in FIG. 14. In addition, a case where male side pipe 13 illustrated in FIG. 3 is fitted into female side pipe 14 with an inclination is illustrated in FIG. 15. FIG. 16 is an enlarged view of point P in FIGS. 14 and 15.

The widened part 13*b* of the male side pipe 13 serves to guide the male side pipe 13 to be inserted into the female side pipe 14, and long widened part 13*b* operates to prevent the O-ring from being displaced askew in assembling, and, as a result, leakage therefrom is prevented.

Therefore, when male side pipe 13 illustrated in FIG. 4 is used for assembling, as widened part 13*b* is Short, male side pipe 13 may be inclined at a large angle when inserted into female side pipe 14 as illustrated in FIG. 14. In this case, O-ring 12 may contact tip end part 18*e* of female side pipe 14 as illustrated in FIG. 16 and, as a result, the O-ring may be displaced askew during assembly.

On the other hand, when male side pipe 13 illustrated in FIG. 3 is used for assembly, as widened part 13*b* is long, male side pipe 13 is guided until inserted into female side pipe 14 to a deeper portion as illustrated in FIG. 15. Accordingly, O-ring 12 contacts tapered part 18*d* of female side pipe 14, whereby the O-ring is prevented from being caught.

As is evident from the above, it is advisable that seal groove side face 16*a* at the side of tip end 13*a* should be formed as perpendicular as possible to the axial direction of male side pipe 13 so that male side pipe 13 can have a long widened part 13*b*.

Figure 6:
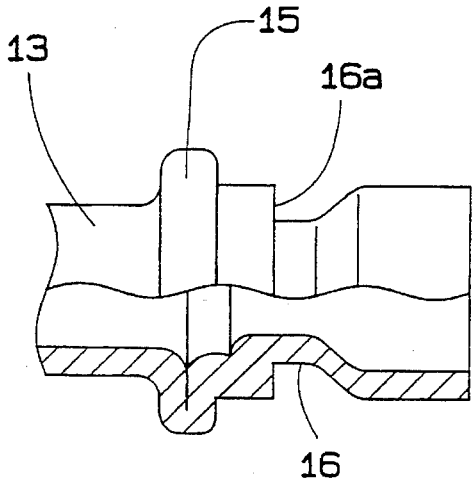
FIG. 6 is a partially cut away cross-sectional view illustrating a male side pipe with a buckled portion.
Figure 7:
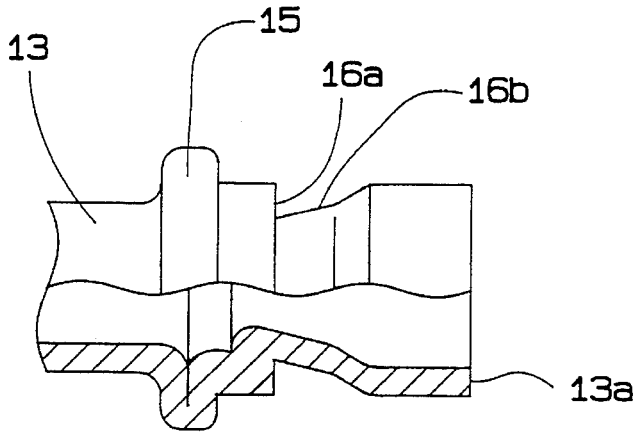
FIG. 7 is a partially cut away cross-sectional view showing a male side pipe with a deformed seal groove bottom face.

In addition, if the machining on the tip end portion of male side pipe 13 can not easily be performed, a buckling may occur between seal groove side face 16*a* and seal groove bottom face 16*b* at the side of bulge part 15 as illustrated in FIG. 6 or seal groove bottom face 16*b* may be deformed as illustrated in FIG. 7. As a result, the durability of male side pipe 13 may be lowered, or defective sealing may be caused due to deformation of O-ring 12. In order to prevent this trouble, it is advisable that the portion of male side pipe 13 at the side of tip end 13*a* from point P should be thinned in the sixth step as described in with respect to the first embodiment.

Next, the third embodiment will be described.

A producing method in which the present invention is applied to hose 10 will be described as the third embodiment.

Figure 2:
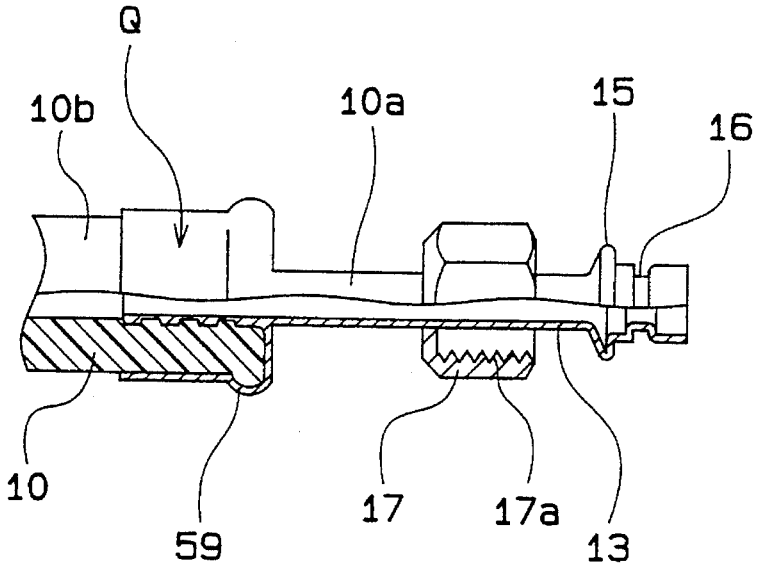
FIG. 2 is a partially cut-away cross sectional view depicting the hose pipe produced according to the present invention.

FIG. 2 is a one-side cross-sectional view of a hose pipe, i.e., hose, 10 used in a motor vehicle. Hose 10 comprises rubber part 10*b* and pipe part 10*a* which are connected by caulking the point Q of sleeve 59. In pipe part 10*a*, nut 17 is set on male side pipe 13 to connect hose 10 to a compressor 1, a condenser 2, etc.

Here, male side pipe 13 of the hose 10 is provided with an annular bead part 15 on the outer periphery at the side of the tip end, i.e., right side in FIG. 2, like male side pipe 13 of pipe 9. At the side of the end tip from the bead part, bulge part 15, annular seal groove 16 for holding O-ring 12 is formed. Male side pipe 13 normally comprises a material pipe made of metal, such as aluminum, copper, brass, stainless steel, iron or the like. In this embodiment, high-strength aluminum A6063-T83 is used as the material of male side pipe 13 for the reason that sufficient strength is needed in piping part 10*a* for caulking rubber part 10*b* and pipe part 10*a*. However, there is a problem that a high-strength material can not easily be machined. Therefore, the above material can not be machined well by using the same method as that of the first embodiment.

To solve this problem, as illustrated in FIG. 7, the portion of male side pipe 13, including pipe part 10*a*, from tip end 13*a* to point U is cut at the side of the inside diameter to be thinned so that male side pipe 13 can easily be pressed. In this embodiment, the male side pipe 13 is thinned for a length between 23 mm to 24 mm from tip end 13*a*. The above process corresponds to the claimed "cutting process."

Next, the cut portion is heated to a temperature higher than 580° C. (1076° F.) in an induction hardening device for annealing. This process corresponds to the "annealing process". The Vickers hardnesses of respective portions of the annealed male side pipe 13 are illustrated in FIG. 9.

Figure 9:
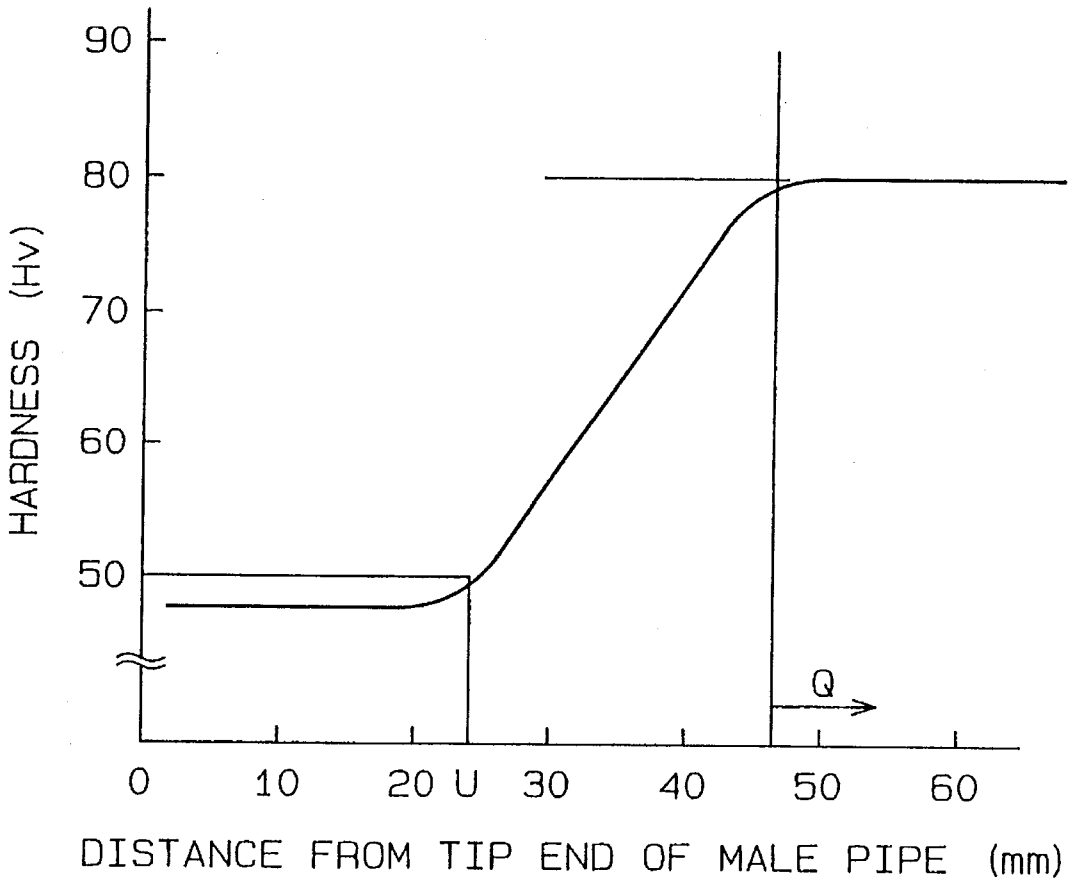
FIG. 9 is a graph illustrating the hardness of the male side pipe after the annealing process.

In FIG. 9, the ordinate denotes the Vickers hardness (in Hv), and the abscissa denotes the distance (in mm) from tip end 13*a* of male side pipe 13.

From this figure, it is understood that the hardness of the portion from tip end 13*a* to point U in FIG. 9 is low with a Vickers hardness of under 50 (Hv). The Vickers hardness is somewhat higher in the vicinity of point U, but it does not pose any serious problem with press machining. From the above fact, it can be judged that male side pipe 13 can be machined into a cylindrical seal shape by using the same method as that in the first embodiment.

The point Q of male side pipe 13, at which the male side pipe 13 and the rubber part 10*b* are caulked through the sleeve 59, is large in thickness and high in Vickers hardness which is higher than 80 (Hv) and almost equal to that of the material pipe. The Vickers hardness is slightly low in the vicinity of point Q, but it does not pose any serious problem with press machining. Therefore, male side pipe 13 can be press machined while maintaining sufficient strength in caulking.

As described above, the machining on male side pipe 13 into a cylindrical seal shape can be performed more easily by cutting tip end of male side pipe 13 at the side of the inside diameter by thinning and annealing male side pipe 13 for softening.

Figure 18:
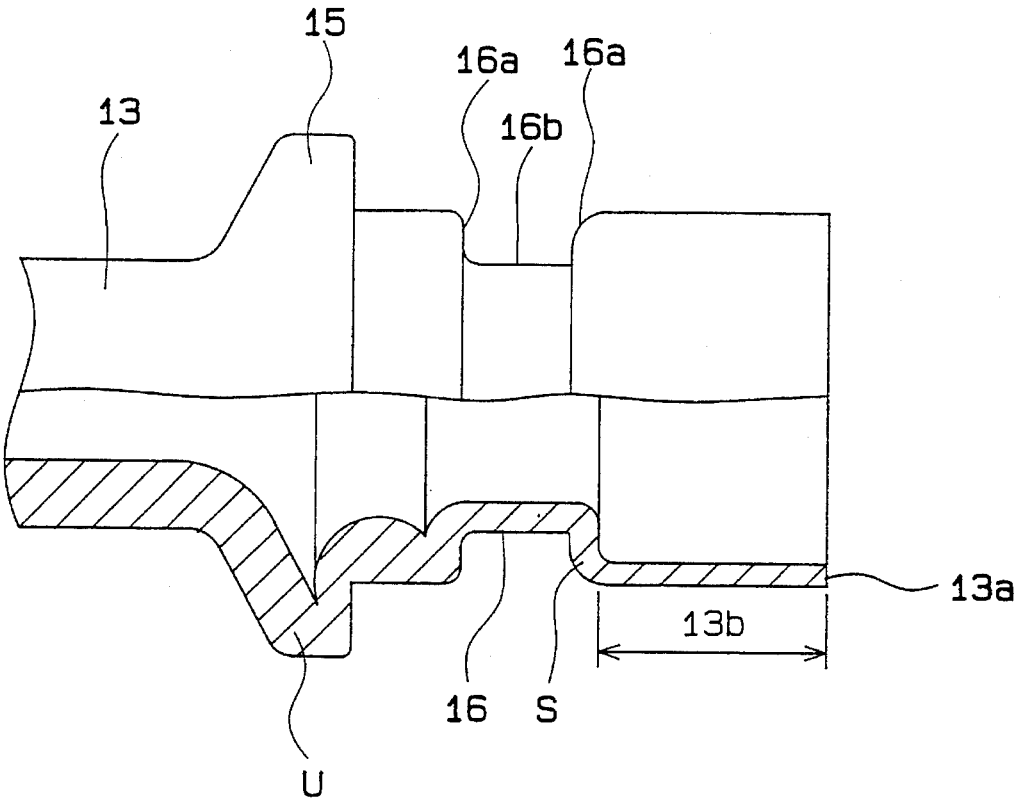
FIG. 18 is an enlarged partially cut away cross-sectional view illustrating the male side pipe produced according to the present invention.

By setting male side pipe 13 on press machine 11 and performing the press machining described in-the first through the eighth steps as in the first embodiment, male side pipe 13 used for the hose 10 can be formed into a cylindrical seal shape as illustrated in FIG. 18.

The case where the producing method according to the present invention was applied to pipe 9 of the nut-union connection type was described in the first and second embodiments, and the case where the producing method according to the present invention is applied to hose 10 of the nut-union connection type is described in third embodiment. Furthermore, it is also possible that the connection of pipe 9 or hose 10 is made with a block joint made of a resin or a metal.

While the present invention has been described in connection with what are presently considered to be the most practical and preferred embodiments, the invention is not intended to be limited to the disclosed embodiments. Rather, the present invention is intended to encompass all modifications and equivalent arrangements included within the spirit and scope of the appended claims.

What is claimed is:

1. A method of producing a bulge-shaped pipe comprising the steps of:

pressing a metal pipe piece having a predetermined length to expand a first intermediate part of said pipe outwards to form an expanded portion of said pipe;

separate from said step of pressing said metal pipe piece, pressing said expanded portion of said pipe to form a bulge-shaped portion;

after said step of pressing said expanded portion, externally pressing said pipe to contract said pipe towards an interior thereof at a first portion between a tip end of said pipe and a second intermediate part of said pipe; and after said step of externally pressing, widening towards an exterior of said pipe for a second predetermined length of said first portion to form a groove in said pipe.

2. The method of producing a bulge-shaped pipe according to claim 1, further comprising a second widening step of widening an inner diameter of said pipe before said metal pipe pressing step.

3. The method of producing a bulge-shaped pipe according to claim 1, wherein said external pressing step forms a contracted portion and a non-contracted portion, and further comprising the step of pressing a part of said pipe at a second portion between the contracted portion and the non-contracted portion to make said second portion be roughly perpendicular to an axial direction of said pipe, said step of pressing a part occurring between said external pressing step and said widening step.

4. The method of producing a bulge-shaped pipe according to claim 1, wherein said external pressing step forms a contracted portion and a non-contracted portion, and wherein said external pressing step includes:

forming a face of said pipe at an inclination angle between 15° and 30° to an axial direction of said pipe between said contracted portion and said non-contracted portion of said pipe by externally pressing said pipe and contracting said pipe towards the interior thereof at said first portion of said pipe; and forming said face to a second inclination angle of approximately 45° to the axial direction of said pipe between said contracted portion and said non-contracted portion by externally pressing said pipe and contracting said pipe towards the interior thereof at said first portion.

5. A method of producing a bulge-shaped pipe according to claim 3, wherein said step of pressing said pipe at a second portion comprises:

internally pressing said pipe to reduce a thickness thereof at least a part of said first portion and pressing said second portion to form said second portion to be roughly perpendicular to the axial direction of said pipe.

6. A method of producing a bulge-shaped pipe according to claim 1, further comprising the step of pressing a third portion of said pipe between a widened portion widened in said widening step and a non-widened portion to form said third portion roughly perpendicular to the axial direction of said pipe, said step of pressing said third portion occurring after said widening step.

7. A method of producing a bulge-shaped pipe according to claim 1, further comprising the step of cutting an interior diameter of said pipe prior to said metal pipe piece pressing step.

8. A method of producing a bulge-shaped pipe according to claim 7, further comprising the step of annealing said pipe at said interior diameter after said cutting step.

9. A method for forming a pipe having a bulge-shaped portion by utilizing a press machine having a plurality of punches, each punch having inner and outer punch members, said method comprising the steps of:

widening a pipe to form an expanded part thereof by inserting into an interior of said pipe a first inner punch member and holding an exterior of said pipe with a first outer punch member;

forming a bulged part in said expanded part by inserting into said interior a second inner punch member and holding an exterior of said pipe with a second outer punch member;

forming an inclined face above said bulged part by contracting said pipe from a tip thereof to a starting point of said inclined face by using a third inner punch member and a third outer punch member;

reforming said inclined face so as to have a larger angle of inclination by using a fourth inner punch member and a fourth outer punch member;

forming a groove in an outer surface of said pipe by using a fifth inner punch member, an intermediate punch member and a fifth outer punch member;

adjusting depth of said groove by using a sixth inner punch member and a sixth outer punch member; and completing formation of said groove using an seventh inner punch member and an seventh outer punch member.

10. A method of producing a bulge-shaped pipe by utilizing a press machine having a plurality of punches, said method comprising the steps of:

expanding a metal pipe that has been cut to a specified length by pressing an inner wall of the metal pipe outwardly with a first inside punch while guiding an outer diameter of said pipe with a first outside punch to outwardly displace inner and outer walls of said metal pipe, thereby forming an expanded portion;

forming said pipe into a bulge shape by pressing said expanded portion of said pipe with a second outside punch while guiding the inside diameter of said pipe with a second inside punch;

contracting said pipe towards an interior thereof to form a contracted portion along a first length between a tip end of said pipe and an intermediate part of the bulge-shaped portion by externally pressing said pipe with a third outside punch while guiding said inside diameter with a third inside punch; and after said contracting step, widening said pipe towards an exterior thereof along a second length between said tip end and said intermediate part to form a groove in said pipe by internally pressing said pipe with a fourth inside punch while guiding said outside diameter of said pipe with a fourth outside punch.

11. The method of claim 10, wherein said first, second, third and fourth outside punches are each different punches and each have at least one of different interior cross-sectional sizes and different interior surface configurations.

12. The method of claim 10, wherein said first, second, third and fourth inside punches are each different punches and each have at least one of different exterior cross-sectional sizes and different exterior surface configurations.

* * * * *